US008837974B2

(12) United States Patent
Sakata

(10) Patent No.: US 8,837,974 B2
(45) Date of Patent: Sep. 16, 2014

(54) IMAGE FORMING APPARATUS, OUTPUT CONTROL METHOD, AND PROGRAM FOR OUTPUTTING CARBONLESS COPY PAPER FOR THE PURPOSE OF CHECKING PRINTING

(75) Inventor: Munetaka Sakata, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 196 days.

(21) Appl. No.: 13/365,570

(22) Filed: Feb. 3, 2012

(65) Prior Publication Data

US 2012/0201549 A1 Aug. 9, 2012

(30) Foreign Application Priority Data

Feb. 9, 2011 (JP) ..... 2011-026394

(51) Int. Cl.
*G03G 15/00* (2006.01)

(52) U.S. Cl.
CPC .. *G03G 15/6591* (2013.01); *G03G 2215/00569* (2013.01)
USPC ..... 399/82; 399/405

(58) Field of Classification Search
CPC ..... G03G 2215/00569; G03G 15/6591; G03G 2215/00443; G03G 2215/00476; G03G 2215/00523; G06K 15/025; G06F 3/1256
USPC ..... 399/72, 82, 405
See application file for complete search history.

(56) References Cited

U.S. PATENT DOCUMENTS

| | | | | |
|---|---|---|---|---|
| 5,672,104 | A * | 9/1997 | Baxter | 462/18 |
| 7,952,731 | B2 * | 5/2011 | Utsunomiya et al. | 358/1.13 |
| 2008/0231888 | A1 * | 9/2008 | Kuwano | 358/1.15 |
| 2012/0063832 | A1 * | 3/2012 | Okada | 400/76 |

FOREIGN PATENT DOCUMENTS

JP 2008-173877 A 7/2008

* cited by examiner

*Primary Examiner* — Daniel J Colilla
*Assistant Examiner* — Justin Olamit
(74) *Attorney, Agent, or Firm* — Canon USA, Inc., IP Division

(57) ABSTRACT

An image forming apparatus includes a specifying unit configured to, when a user operation for instructing checking of printing is performed during printing, specify, according to a type of carbonless copy paper of a page being printed, carbonless copy paper for checking corresponding to the carbonless copy paper being printed, and an output unit configured to output the carbonless copy paper being printed and the carbonless copy paper for checking specified by the specifying unit.

8 Claims, 20 Drawing Sheets

WHEN CHECKING
PRINTING TARGET PAGE IS "CB"

WHEN CHECKING
PRINTING TARGET PAGE IS "CFB"

WHEN CHECKING
PRINTING TARGET PAGE IS "CF"

IMAGE FORMING APPARATUS, OUTPUT CONTROL METHOD, AND PROGRAM FOR OUTPUTTING CARBONLESS COPY PAPER FOR THE PURPOSE OF CHECKING PRINTING

BACKGROUND OF THE INVENTION

1. Field of the Invention

The present invention relates to an image forming apparatus, an output control method, and a program.

2. Description of the Related Art

Among apparatuses used for forming images, there are image forming apparatuses equipped with a function, called a checking printing function, which is useful when Print On Demand (POD) printing is performed. This function is used for checking whether a print job of a large volume is properly printed on recording media. If the user uses this checking printing function, an arbitrary page of a printing job which is being carried out can be discharged to a tray different from the tray where the printed paper of the print job is discharged. According to this function, without affecting the output form (punching, stapling) of the printed paper, the user can check the tint of the printed product and also check the position alignment thereof.

Carbonless copy paper is a recording medium which can be printed by the image forming apparatus. Carbonless copy paper is an alternative to conventional carbon paper (paper inserted between two sheets of paper). When a person writes on the carbonless copy paper, what has been written can be copied to a plurality of sheets, without using carbon paper, according to chemical reaction of color former and color developer.

The carbonless copy paper includes three types of paper. The first carbonless copy paper is called "Coated Back (CB)", in which the color former is applied to the back surface of the recording medium. The second carbonless copy paper is called "Coated Front and Back (CFB), in which the color developer is applied to the front surface and the color former is applied to the back surface of the recording medium. The third carbonless copy paper is called "Coated Front (CF)", in which the color developer is applied to the front surface of the recording medium.

Thus, in making printed paper used for copying written content to a plurality of sheets, these three types of carbonless copy paper will be used. In other words, if the written content is to be copied on four sheets, the sheets (carbonless copy paper) are arranged in order of CB, CFB, CFB, CFB, and CF. According to this configuration, the content written on the CB is copied to a total of four pages (CFB×3 and CF×1).

Since the carbonless copy paper eliminates the use of inserting carbon paper between sheets, its convenience is high. On the other hand, since the carbonless copy paper is copied based on a chemical reaction of the color former and the color developer, if a wrong side of the carbonless copy paper is set, the copying of the written content will be unsuccessful.

Actually, since the color former and the color developer applied to the carbonless copy paper are transparent, it is difficult to visually check whether the paper is set with the correct side up. Thus, in some cases, carbonless copy paper with the wrong side up is set in the paper feed cassette of the image forming apparatus. Then, a printed product that cannot be used for copying the written content may be obtained. Thus, in recent years, there is a growing demand for checking printing of carbonless copy paper and determining whether correct printing is performed on the front/back surface of the carbonless copy paper.

Conventionally, there is a method that changes the checking printing operation by changing a recording medium which is used when the checking printing is performed. This method is discussed in Japanese Patent Application Laid-Open No. 2008-173877. According to this method, if the recording medium of the target page of the checking printing is tab paper, by using plain paper instead of tab paper when the checking printing is executed, the use of tab paper for purposes other than obtaining a printed product can be prevented.

However, according to the method discussed in Japanese Patent Application Laid-Open No. 2008-173877, in order to obtain the correct printed product, the checking printing is performed by changing a recording medium of the target page of the checking printing. In other words, according to the method discussed in Japanese Patent Application Laid-Open No. 2008-173877, since a recording medium of the target page of the checking printing is changed, if the recording medium of the target page of the checking printing is carbonless copy paper, it is difficult to check whether the carbonless copy paper is correctly printed on the front/back surface.

Considering the setting of carbonless copy paper in a paper feed cassette, there are two ways in setting the paper. The first is setting carbonless copy paper of "CB", "CFB", and "CF" in different cassettes. The second is making one set of sheets including "CB"×1, "CFB"×N, and "CF"×1. A plurality of these sets is set in one paper feed cassette.

For example, according to the second style, since the carbonless copy paper is set in one paper feed cassette, only one cassette is necessary in printing the paper. Actually, many types of carbonless copy paper are sold in this style. In the following description, the carbonless copy paper in this form is described as pre-collated carbonless copy paper.

If the target page of the checking printing is pre-collated carbonless copy paper, however, it is necessary to use up one set of sheets (=N+2 sheets). Thus, the checking printing needs to be executed so that one set of sheets is used up for the checking printing.

Further, regarding the first style, a method for performing the checking printing is not discussed when the recording medium of the target page of the checking printing is carbonless copy paper.

SUMMARY OF THE INVENTION

The present invention is directed to an image forming apparatus which is capable of appropriately outputting carbonless copy paper for the purpose of checking printing.

According to an aspect of the present invention, an image forming apparatus includes a specifying unit configured to, when a user operation for instructing checking of printing is performed during printing, specify, according to a type of carbonless copy paper of a page being printed, carbonless copy paper for checking corresponding to the carbonless copy paper being printed, and an output unit configured to output the carbonless copy paper being printed and the carbonless copy paper for checking specified by the specifying unit.

According to an exemplary embodiment of the present invention, carbonless copy paper for checking can be appropriately output.

Further features and aspects of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the invention and, together with the description, serve to explain the principles of the invention.

DESCRIPTION OF THE EMBODIMENTS

Various exemplary embodiments, features, and aspects of the invention will be described in detail below with reference to the drawings.

Figure 1:
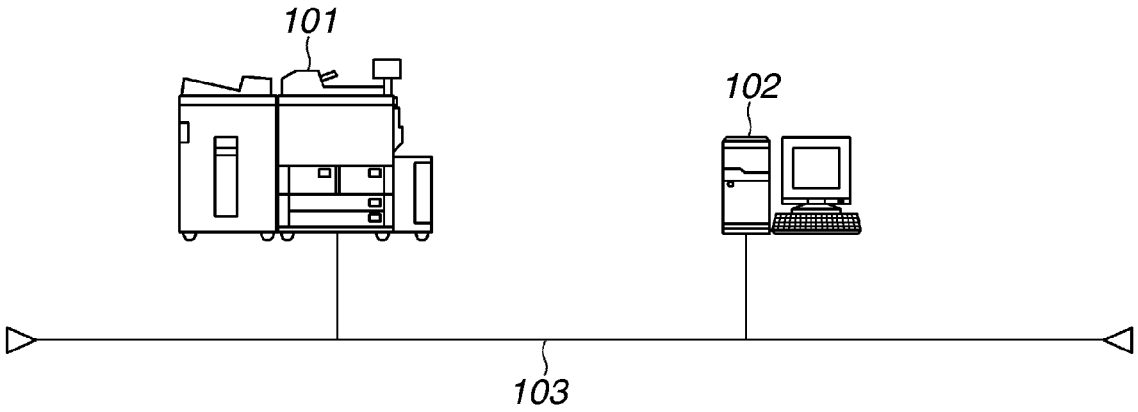
FIG. 1 illustrates an example of a configuration of a printing system according to a first exemplary embodiment of the present invention.

FIG. 1 illustrates an example of a configuration of a printing system according to a first exemplary embodiment of the present invention.

The printing system includes an image forming apparatus 101 and an information processing apparatus 102. The image forming apparatus 101 and the information processing apparatus 102 are connected to each other via a network 103 and can communicate with each other.

The information processing apparatus 102 is a computer such as a server. The information processing apparatus 102 performs processing such as job management, raster image processing (RIP), and imposition, and transmits a print job to the image forming apparatus 101. The image forming apparatus 101 is a multifunction peripheral or the like and performs printing according to a print job.

Figure 2:
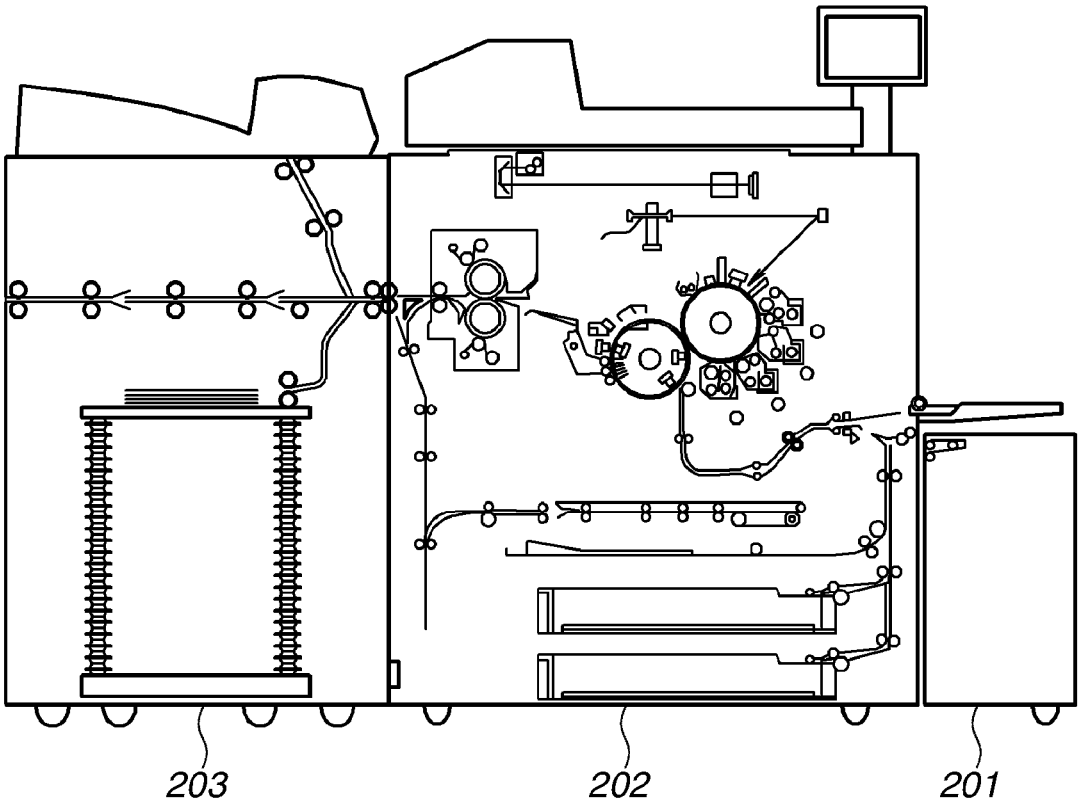
FIG. 2 illustrates an example of a configuration of an image forming apparatus according to the first exemplary embodiment.

FIG. 2 illustrates an example of a configuration of the image forming apparatus 101. The image forming apparatus 101 includes an external paper feeding apparatus 201, an image forming apparatus main body 202, and a large-capacity stacker 203.

The external paper feeding apparatus 201 provides large quantities of paper to the image forming apparatus main body 202. By the use of the external paper feeding apparatus 201, the image forming apparatus main body 202 can continuously execute printing of large quantities of paper. The image forming apparatus main body 202 is a printing unit and executes printing on paper fed from the external paper feeding apparatus 201 or from a paper feed cassette in the image forming apparatus main body 202. The large-capacity stacker 203 is a discharge unit where large quantities of printed paper can be stacked. In most cases, paper set in the external paper feeding apparatus 201 is discharged to the large-capacity stacker 203 after it is printed.

Figure 3:
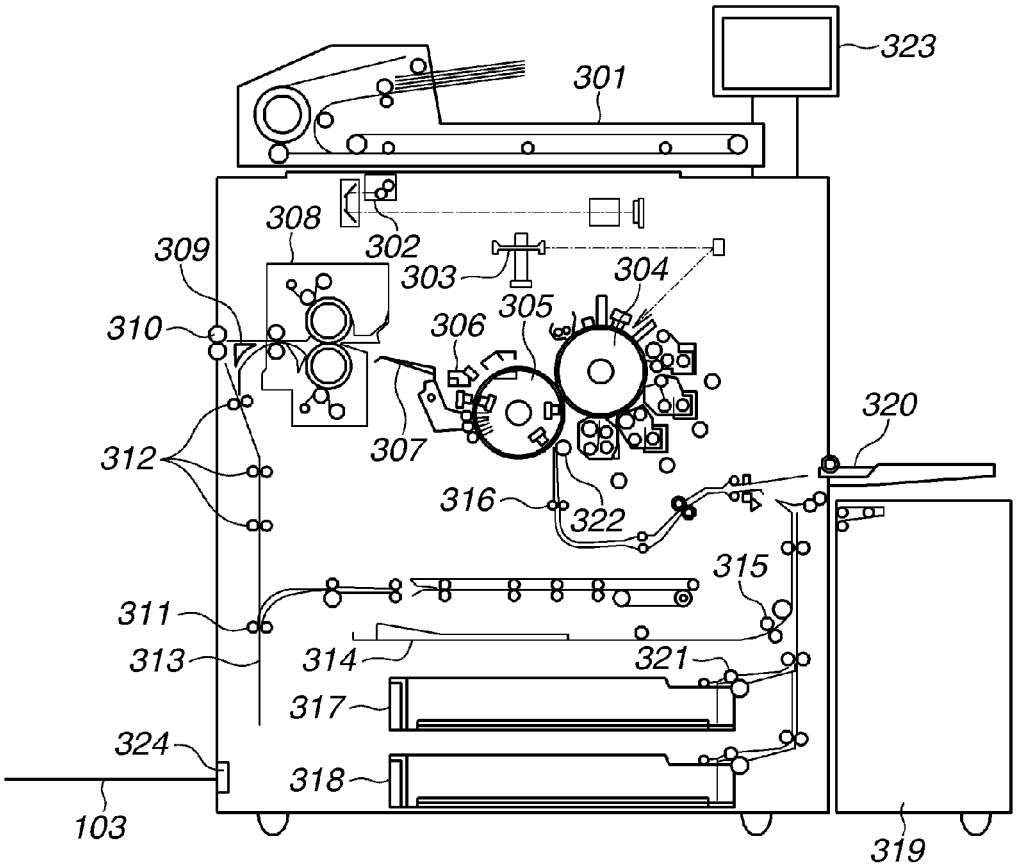
FIG. 3 is a cross-section view of an example of an external paper feeding apparatus and the image forming apparatus main body according to the first exemplary embodiment.

FIG. 3 is a cross-sectional view of an example of the external paper feeding apparatus 201 and the image forming apparatus main body 202.

If a document stack is set on a document tray of the image forming apparatus main body 202, an automatic document feeder (ADF) 301 separates the stack of paper and conveys each sheet from the first page in page order to a document positioning glass plate. Then, a scanner 302 scans the image of the sheet conveyed to the document positioning glass plate and a charge-coupled device (CCD) converts the image into image data. A polygonal mirror 303 reflects an incident light ray such as a laser beam which has been modulated according to the image data. The reflected light is emitted to a photosensitive drum 304 via a reflection mirror as reflected scanning light.

A latent image formed on the photosensitive drum 304 by the laser beam is developed with toner and a toner image is transferred onto a sheet material attached to a transfer drum 305. This image forming processing is sequentially executed for yellow (Y), magenta (M), cyan (C), and black (K) toner. Accordingly, a full-color image is formed. After this image forming processing is repeated four times, a full-color image is formed on the sheet material attached to the transfer drum 305. Then, the sheet with the full-color image is removed from the transfer drum 305 by a separation claw 306 and then conveyed to a fixing device 308 by a pre-fixing carrier 307.

The fixing unit 308 includes rollers and belts and also includes a heat source such as a halogen heater. The fixing unit 308 applies heat and pressure to the sheet to fix the toner transferred to the sheet material. A discharge flapper 309 is arranged in such a manner that it can move about a swing shaft and determines the conveying direction of the sheet material. If the discharge flapper 309 moves in the clockwise direction in FIG. 3, the sheet material is conveyed forward and discharged out of the apparatus by a discharge roller 310.

On the other hand, if the sheet material is to have images printed on both sides, the discharge flapper 309 moves in the counterclockwise direction in FIG. 3. Accordingly, the conveying direction of the sheet material is changed and the sheet material is conveyed down to a two-sided conveyance unit.

The two-sided conveyance unit includes a reversing flapper 311, a reversing roller pair 312, a reversing guide 313, and a two-sided tray 314.

The reversing flapper 311 is swingable about the swing shaft and determines the conveying direction of the sheet material. If a job of two-sided printing is processed, the reversing flapper 311 swings in the counterclockwise direction in FIG. 3. Accordingly, a sheet material having an image fixed to one side of the sheet is conveyed to the reversing guide 313 via the reversing roller pair 312. While the trailing edge of the sheet material is nipped by the reversing roller pair 312, the rotation of the reversing roller pair 312 is stopped for a time. Then, the reversing flapper 311 swings in the clockwise direction in FIG. 3. At the same time, the reversing roller pair 312 starts to rotate in the opposite direction. In this manner, the direction of travel of the sheet material is reversed. Accordingly, the sheet material is conveyed to the two-sided tray 314 with the former trailing edge changed to the leading edge.

The sheet material loaded on the two-sided tray 314 is conveyed again to a registration roller pair 316 by a re-feed roller 315. When the sheet material is conveyed, the side facing the photosensitive drum is different from the side that has undergone the transfer processing. Then, an image is formed on the other side of the sheet material. The image forming processing of this side is similar to the processing described above. In this manner, images are formed on both sides of the sheet material. Then, after going under the fix processing, the image-formed sheet material is discharged from the image forming apparatus main body 202 by the discharge roller 310. According to this two-sided printing sequence, two-sided printing on both sides of the sheet material is executed by the image forming apparatus 101.

Further, the image forming apparatus main body 202 includes a paper feed roller 321 and the registration roller pair 316, which are used when a sheet material is fed from a paper feeding unit that stores sheet materials used for the print processing. The paper feeding unit is an example of a storage unit that stores various types of paper. Paper feed cassettes 317 and 318 can store, for example, up to 500 sheet materials. An external paper feeding apparatus 319 can store, for example, up to 3000 sheet materials. Additionally, a manual feed tray 320 is also used as the paper feeding unit.

Each of the paper feed cassettes 317 and 318 and the external paper feeding apparatus 319 stores various sheet materials of various sizes. The manual feed tray 320 is used for feeding of various print media including special sheet materials. For example, an overhead projector (OHP) sheet can be fed from the manual feed tray 320.

The paper feed roller 321 is provided for each of the paper feed cassettes 317 and 318, the external paper feeding apparatus 319, and the manual feed tray 320. According to the paper feed roller 321, sheet materials can be continuously fed from the paper feeding unit one sheet at a time. Sheet materials set in the paper feeding unit are sequentially picked up by a pick-up roller. Since double feeding is prevented by a separation roller that is located opposite the paper feed roller 321, the sheet materials are conveyed to a conveying guide one sheet at a time.

A driving force that causes the separation roller to rotate in the direction opposite to the conveying direction is applied to the separation roller via a torque limiter (not illustrated). To be more precise, if one sheet material is guided to a nip portion between the separation roller and the paper feed roller 321, the separation roller rotates in the conveying direction following the movement of the sheet material. On the other hand, if double feeding occurs, the separation roller rotates in a direction opposite to the conveying direction. The double-fed sheet materials are conveyed back, and only the top sheet passes the nip portion.

The sheet material is guided through the conveying guide and conveyed to the registration roller pair 316 by a plurality of conveyance rollers. Since the registration roller pair 316 is not rotating when the sheet material is conveyed to the registration roller pair 316 by the conveyance rollers, when the leading edge of the sheet material contacts a nip portion formed by the registration roller pair 316, a loop is formed. According to this loop, any skew of the sheet material is corrected. Then, the registration roller pair 316 starts to rotate at such timing that matches the formation of the toner image on the photosensitive drum 304, and the sheet material is conveyed to the image forming portion.

The sheet material conveyed by the registration roller pair 316 is electrostatically attracted to the surface of the transfer drum 305 by an attracting roller 322. The sheet material which has undergone the processing of the fixing unit 308 is discharged out of the apparatus via the discharge roller 310.

An operation panel 323 is an operation unit including a liquid crystal display (LCD) and receives various specified setting item values (setting values) regarding copying and the image forming apparatus 101.

A network connector 324 is a connection unit configured to connect the image forming apparatus main body to the network 103. For example, the network connector 324 is an RJ-45 connector for communication.

The print side when one-sided printing is performed is different from the first printing side of two-sided printing. In other words, the sheets in the paper feed cassettes 317 and 318 are set with the side to be printed face down, whereas the sheets in the external paper feeding apparatus 319 and the manual feed tray 320 are set with the side to be printed face up.

In other words, in setting a sheet material such as carbonless copy paper in the paper feeding unit, additional care needs to be taken. This is because carbonless copy paper requires extra attention in setting the right face up in the paper feeding unit. If carbonless copy paper is set with the wrong face up, a desired printed product cannot be obtained.

Figure 4:
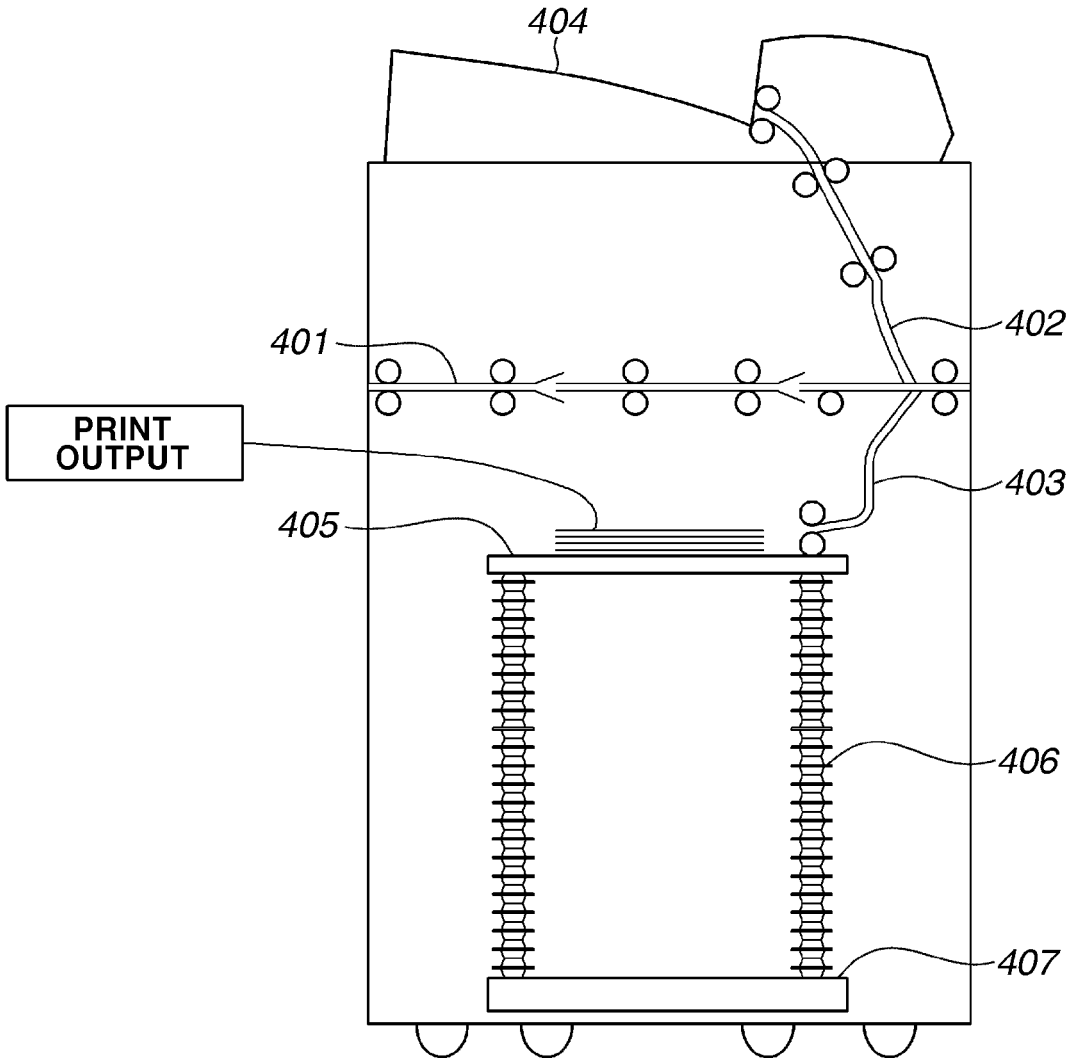
FIG. 4 illustrates an example of a cross section of a large-capacity stacker according to the first exemplary embodiment.

FIG. 4 is a cross-sectional view of an example of the large-capacity stacker 203.

The large-capacity stacker 203 includes three conveyance paths: a straight path 401, an escape path 402, and a stack path 403. Further, the large-capacity stacker 203 includes an escape tray 404 and a stack tray 405.

The straight path 401 is a path along which the sheet material transferred from the image forming apparatus main body 202 is conveyed. If the sheet is processed by an apparatus (not illustrated) in the subsequent stage, the sheet material is conveyed to such an apparatus in the subsequent stage via the straight path 401.

The escape path 402 is used for discharging a sheet material without stacking it. For example, when a checking operation (checking printing) is performed, the sheet to be checked is conveyed along the escape path 402 and discharged to the escape tray 404. A plurality of sensors that detects the conveyance status of the sheet material and occurrence of paper jam is provided along the sheet conveyance path inside the large-capacity stacker 203.

The stack path 403 is a path along which a sheet material is conveyed before it is stacked on a stacking unit (the stack tray 405) of the large-capacity stacker 203. For example, if a request for stacking the sheets is transferred from the user, the sheet materials are discharged to the stack tray 405 via the stack path 403.

The stack tray 405 is an example of a stacking unit mounted on an extendable stay 406. A shock absorber is provided at a joint portion of the stack tray 405 and the extendable stay 406. Further, a carriage 407 is placed under the extendable stay 406. By an attachment of a handle (not illustrated) on the carriage 407, the carriage 407 with the sheet materials (stack output) can be conveyed to another offline finisher.

Further, if the front door of the large-capacity stacker is closed, the extendable stay 406 is elevated to a position where the sheets can be stacked more easily. On the other hand, if the front door is opened by the operator (or if an open instruction is given), the stack tray 405 is lowered so that the operator can easily take out the stacked paper.

According to the above-described configurations, the large-capacity stacker 203 discharges large quantities of printed paper to the stack tray 405 and discharges a small amount of printed paper, such as a checking print, to the escape tray 404.

Figure 5:
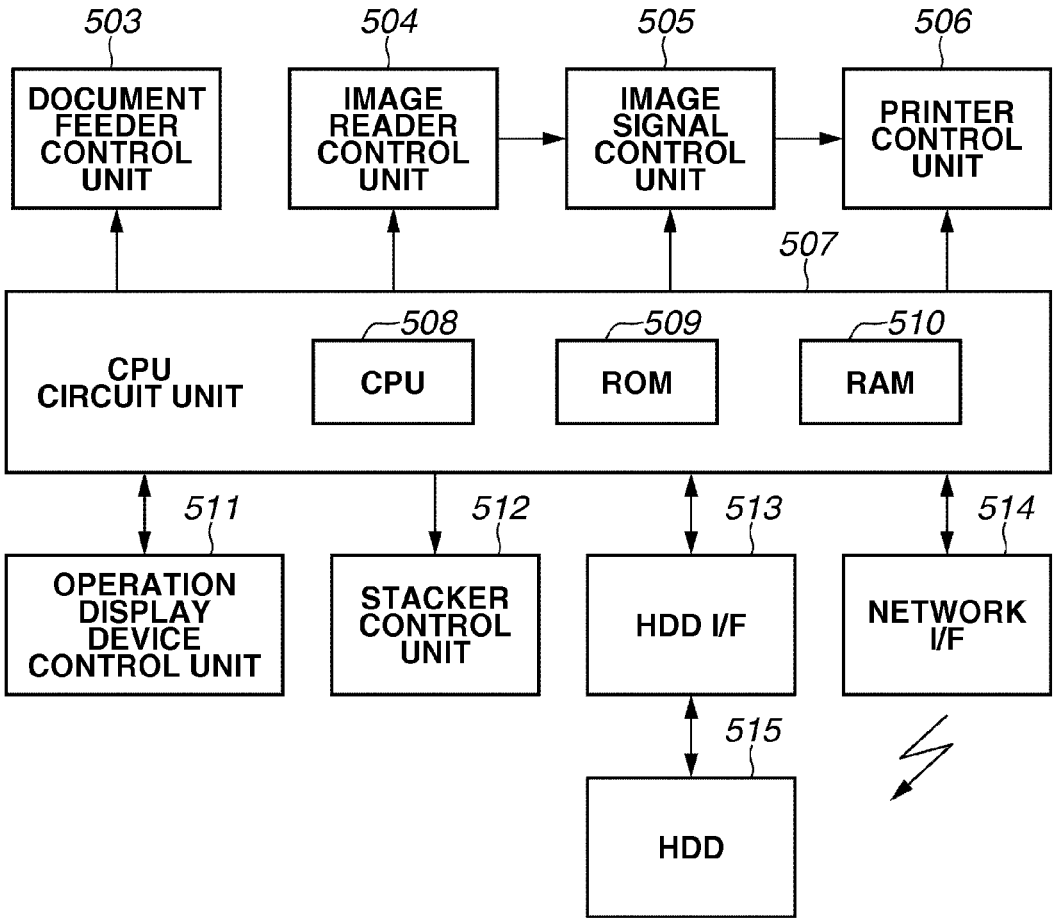
FIG. 5 illustrates an example of a hardware configuration of the image forming apparatus according to the first exemplary embodiment.

FIG. 5 illustrates an example of a hardware configuration of the image forming apparatus 101.

A central processing unit (CPU) circuit unit 507 includes a CPU 508 and controls various control units according to a program stored in a read-only memory (ROM) 509 and setting information received via an operation display device control unit 511. The control units include a document feeder control unit 503, an image reader control unit 504, an image signal control unit 505, a printer control unit 506, a stacker control unit 512, a hard disk drive (HDD) I/F 513, and a network I/F 514.

The document feeder control unit 503 controls the automatic document feeder 301. The image reader control unit 504 controls the scanner 302. The printer control unit 506 controls the photosensitive drum 304, the fixing unit 308, and the paper feed cassette 317. The stacker control unit 512 controls the large-capacity stacker 203.

The HDD I/F 513 is an interface unit for an HDD 515 and controls reading/writing of the HDD 515. The HDD 515 is a large capacity storage unit used for storing non-volatile data. The network I/F 514 controls data transmission/reception via the network 103.

A random access memory (RAM) 510 is used for temporarily storing control data and is also used as a working area of the calculation necessary in controlling the units. The network I/F 514 is connected to the information processing apparatus 102 via the network 103.

An image read by the scanner 302 is transferred from the image reader control unit 504 to the image signal control unit 505. An image transferred from the image signal control unit 505 to the printer control unit 506 goes under the image forming processing and is printed on a sheet material fed from, for example, the paper feed cassette 317.

The printed sheet material goes under the post-processing according to the user's designation. The post-processing is performed by the stacker control unit 512. For example, the stacker control unit 512 performs the post-processing if the sheet materials are discharged to the large-capacity stacker 203. Additionally, the stacker control unit 512 controls the discharge of the sheet material to the escape tray 404 or the stack tray 405 if such a tray is designated as the discharge destination.

The operation display device control unit 511 exchanges information between the operation panel 323 and the CPU circuit unit 507. The operation panel 323 includes a plurality of keys which the user operates when inputting various setting values regarding image forming as well as a display unit configured to display information of the setting state. The operation display device control unit 511 outputs a key signal corresponding to each key operation to the CPU circuit unit 507 and displays the corresponding information on the display unit according to a signal sent from the CPU circuit unit 507.

Figure 6:
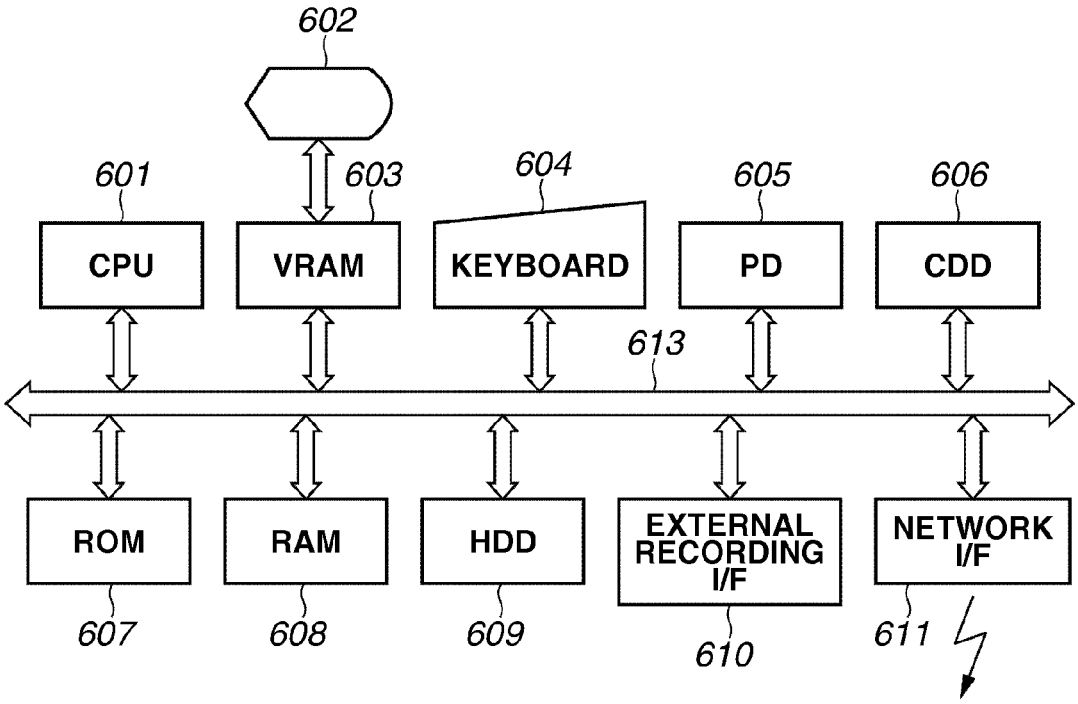
FIG. 6 illustrates an example of a hardware configuration of the information processing apparatus according to the first exemplary embodiment.

FIG. 6 illustrates an example of a hardware configuration of the information processing apparatus 102.

A CPU 601 controls each device connected to the CPU 601 based on a control program stored in a ROM 607, an HDD 609, or a compact disk drive (CDD) 606.

A display device 602 is, for example, a liquid crystal display. Various items including a window, icon, message, menu, and other user interface information are displayed on the display screen. A video random access memory (VRAM) 603 generates image data to be displayed on the display device 602. The image data generated by the VRAM 603 is transferred to the display device 602 and an image is displayed on the display device 602.

A keyboard 604 includes various keys used for inputting, for example, characters. A pointing device (PD) 605 is used for pointing, for example, an icon, menu, and other objects displayed on the display screen of the display device 602. The CDD 606 is a unit used for reading and writing of various control programs and data. Reading and writing of a recording medium such as a CD-ROM or a CD-R is enabled by the CDD 606. A DVD drive can be used in addition to or in place of the CDD 606.

The ROM 607 stores various control programs and data. A RAM 608 includes a work area, a save area when an error is being handled, and a load area of the control program of the CPU 601.

For example, the information processing apparatus 102 performs RIP processing of the electronic data and transmits the obtained data to the image forming apparatus 101. The program used for the RIP processing is stored in the ROM 607. When the information processing apparatus 102 performs the RIP processing, the program stored in the ROM 607 is loaded into a work area of the CPU 601 or the RAM 608 and is then executed.

The HDD 609 serving as an internal recording unit stores various control programs and various types of data. An external recording I/F 610 is used for reading/writing of data in an external recording medium such as a USB memory.

A network I/F 611 is used for data transmission/reception for the image forming apparatus 101 via the network 103. A CPU bus 613 includes an address bus, a data bus, and a control bus. A control program used by the CPU 601 is provided from the CDD 606, the ROM 607, or the HDD 609.

Figure 7:
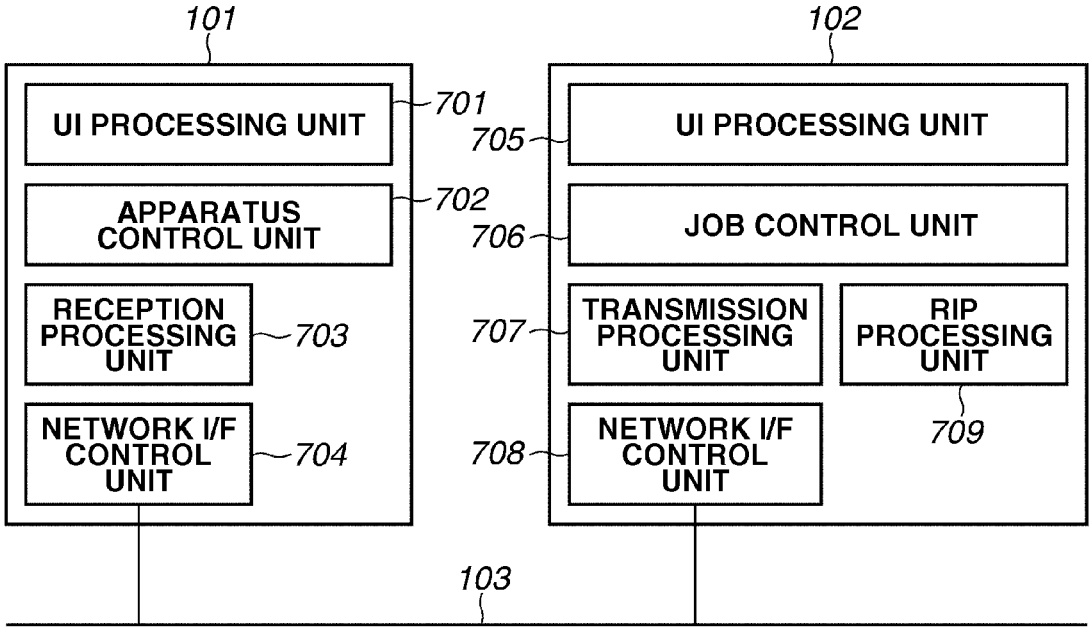
FIG. 7 illustrates an example of a software configuration of the image forming apparatus and the information processing apparatus according to the first exemplary embodiment.

FIG. 7 illustrates an example of a software configuration of the image forming apparatus 101 and the information processing apparatus 102.

A user interface (UI) processing unit 701, an apparatus control unit 702, a reception processing unit 703, and a network interface (I/F) control unit 704 are software implemented when a program is executed by the CPU circuit unit 507 of the image forming apparatus 101. In other words, functions of the image forming apparatus 101, processing related to the screens described below, and processing related to flowcharts described below are implemented according to the CPU circuit unit 507 performing the processing according to the sequences of the programs stored, for example, in the ROM 509.

The UI processing unit 701 performs interface processing with the user by controlling key input and content displayed on the operation panel 323 of the image forming apparatus 101. For example, in receiving a value of a setting item regarding the image forming apparatus 101, the UI processing unit 701 controls the operation display device control unit 511 so that a screen concerning the setting item is displayed on the operation panel 323. Further, in storing a value (setting value) designated for a setting item on the screen, the UI processing unit 701 stores the setting value in the HDD 515 by controlling the HDD I/F 513.

The apparatus control unit 702 performs processing such as printing and apparatus information setting management of the image forming apparatus 101. The reception processing unit 703 receives the image (RIP image) which has undergone the RIP processing by the information processing apparatus 102 via the network I/F control unit 704 and transfers the RIP image to the apparatus control unit 702 on a page-by-page basis.

The network I/F control unit 704 cooperates with a network I/F control unit 708 and performs data communication processing between the image forming apparatus 101 and the information processing apparatus 102 via the network 103.

A UI processing unit 705, a job control unit 706, a transmission processing unit 707, the network I/F control unit 708, and an RIP processing unit 709 are software implemented by the execution of a program by the CPU 601 of the information processing apparatus 102. Thus, the function of the information processing apparatus 102 and the screen processing described below are implemented by the CPU 601 performing processing according to the sequences of the program stored in the ROM 607.

The UI processing unit 705 performs display processing of various screens concerning job management application on the display device 602 of the information processing apparatus 102 and transfers job setting information which can be received by the job management application to the job control unit 706.

The job control unit 706 performs processing of a print job performed by the image forming apparatus 101. The transmission processing unit 707 transfers an RIP image to the image forming apparatus 101 on a page-by-page basis via the network I/F control unit 708. The network I/F control unit 708 cooperates with the network I/F control unit 704 and performs data communication processing between the image forming apparatus 101 and the information processing apparatus 102 via the network 103.

According to the present embodiment, the following processing is performed when an RIP image is printed by the image forming apparatus 101.

First, the job control unit 706 instructs the RIP processing unit 709 to perform rendering of the electronic data, and transmits an RIP image to the image forming apparatus 101 via the transmission processing unit 707. Further, the job control unit 706 transmits the job setting information to the image forming apparatus 101 via the network I/F control unit 708 at timing appropriate for transmission of the RIP image.

The apparatus control unit 702 receives the RIP image via the reception processing unit 703, and transfers the image data to the image signal control unit 505. At the same time, the apparatus control unit 702 receives the job setting information from the network I/F control unit 708 via the network I/F control unit 704.

Next, based on the job setting information, the apparatus control unit 702 sends out an instruction regarding a discharge destination or a paper feed cassette to the printer control unit 506 and further sends out an instruction to the image signal control unit 505 to transfer the image data to the printer control unit 506. In preparation for a user's request for checking printing, the apparatus control unit 702 temporary stores the image data in the HDD 515 and deletes the image data from the HDD 515 when the temporary storage of the image data is no longer necessary (e.g., when the job is completed).

Figure 8:
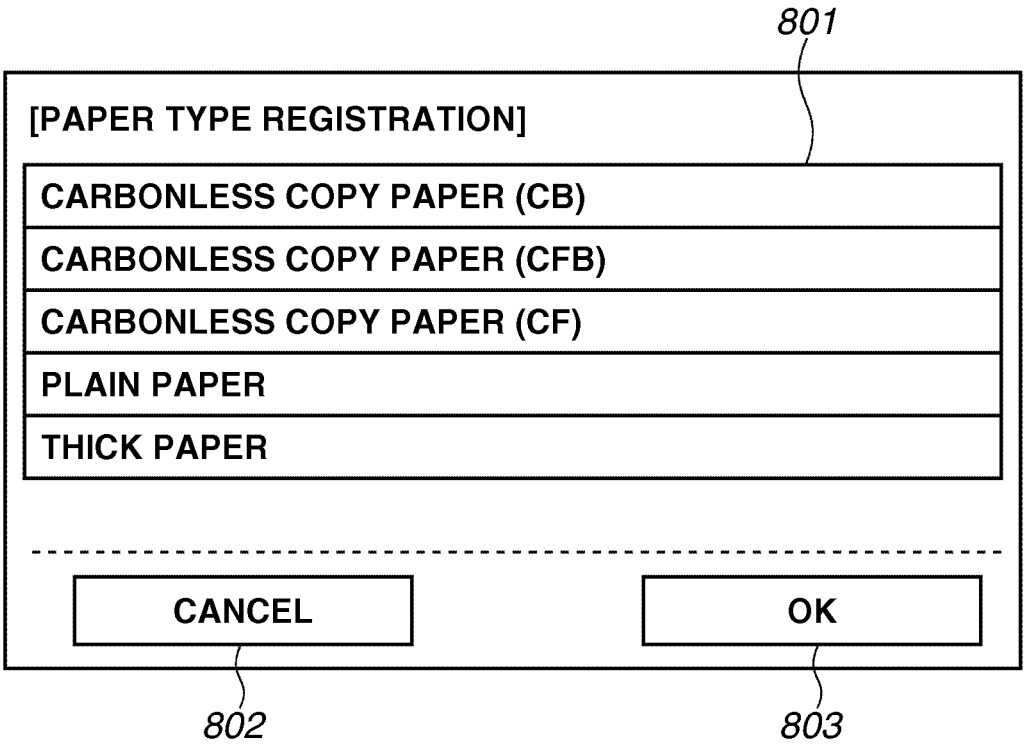
FIG. 8 illustrates an example of a registration screen.

FIG. 8 illustrates an example of a registration screen used for registration of the paper type and displayed on the display unit 602 of the image forming apparatus 101. The registration of the paper type is performed for all the paper feeding units (the paper feed cassettes 317 and 318, the manual feed tray 320, and the external paper feeding apparatus 201) of the image forming apparatus 101 and the type of paper which is currently set in the paper feeding units can be registered.

A list 801 is a list of paper types (an example of sheet materials) which can be registered. In FIG. 8, the list includes carbonless copy paper (CB) as an example of the top sheet, carbonless copy paper (CFB) as an example of the middle sheet, carbonless copy paper (CF) as an example of the bottom sheet, plain paper, and thick paper.

A cancel button 802 is used for cancelling the content in the process of registration. If the user clicks the cancel button 802, the content in the process of registration will be cancelled. Further, an OK button 803 is used for registering the content in the process of registration. If the user clicks the OK button 803, the paper type in the process of registration will be reflected. For example, information of the paper feeding unit and the paper type corresponding to the paper feeding unit will be stored in the HDD 515.

Figure 9:
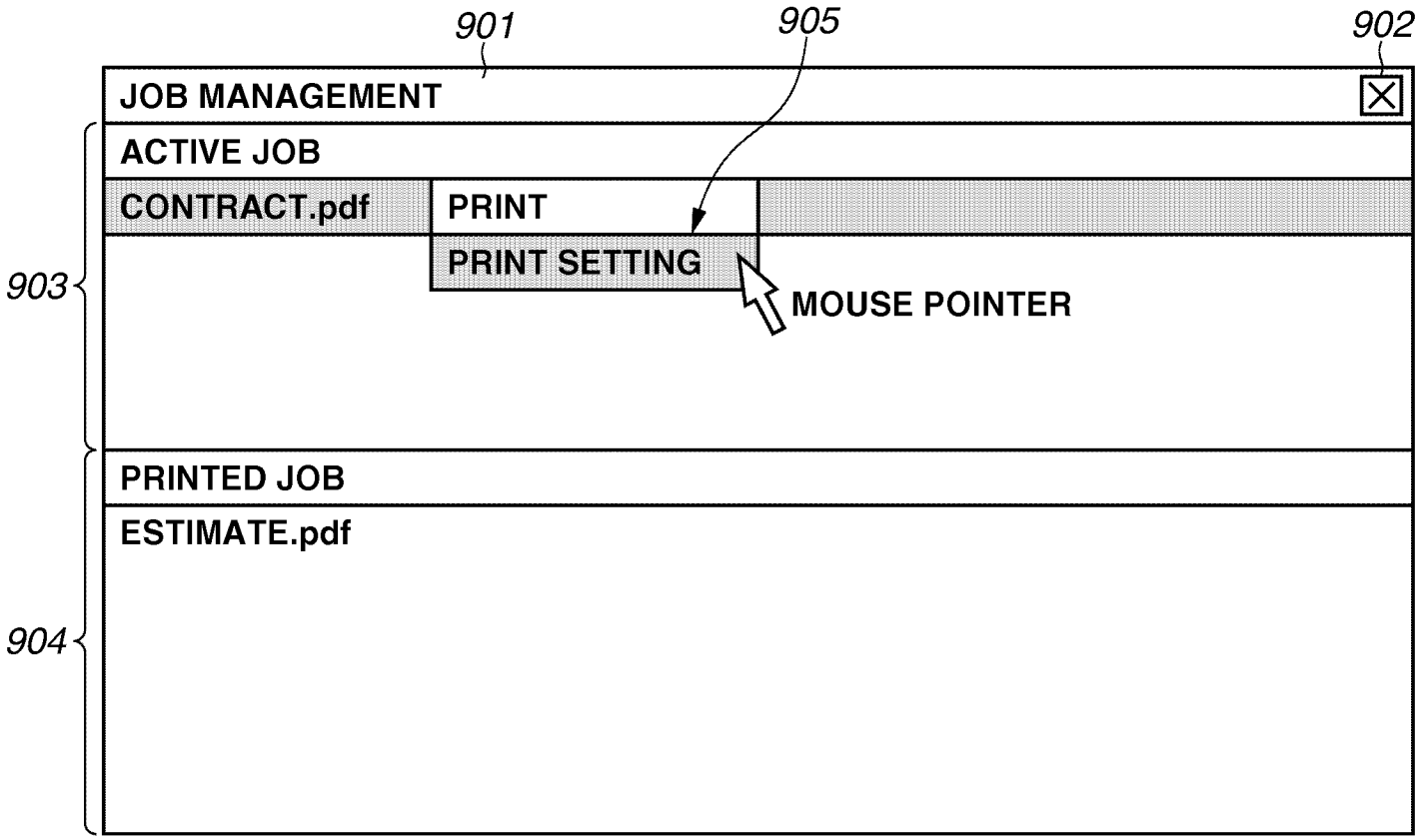
FIG. 9 illustrates an example of a job management screen.

FIG. 9 illustrates an example of a job management screen used for job management and displayed on the display unit 602 of the information processing apparatus 102. The screens illustrated in FIGS. 9 to 12 are examples of a screen of a job management application.

A title bar 901 on the job management screen is where the name of the job management application is displayed. A close button 902 is used for closing the job management application. If the user clicks the close button 902, the job management application ends.

An active job window 903 is where a list of print jobs (hereinafter referred to as jobs as appropriate) stored in the information processing apparatus 102 is displayed. In FIG. 9, the job management screen indicates that a job with a name "contract.pdf" is stored in the information processing apparatus 102.

Further, if the user clicks the right mouse button on a job displayed in the active job window 903, a property 905 used for executing "print" and "print setting" is displayed. If the user selects "print" in this state, the printing will be executed. Further, if the user selects "print setting", the value of the print setting item can be changed. Details of the setting are described with reference to FIGS. 10 to 12 below.

A job history window 904 is where a printing-completed job (historic record) is displayed. On the job management screen, a job with a name "estimate.pdf" is displayed as a historic record. Unlike the job in the active job window 903, the print setting of the job in the job history window 904 cannot be changed and printing cannot be executed.

Figure 10:
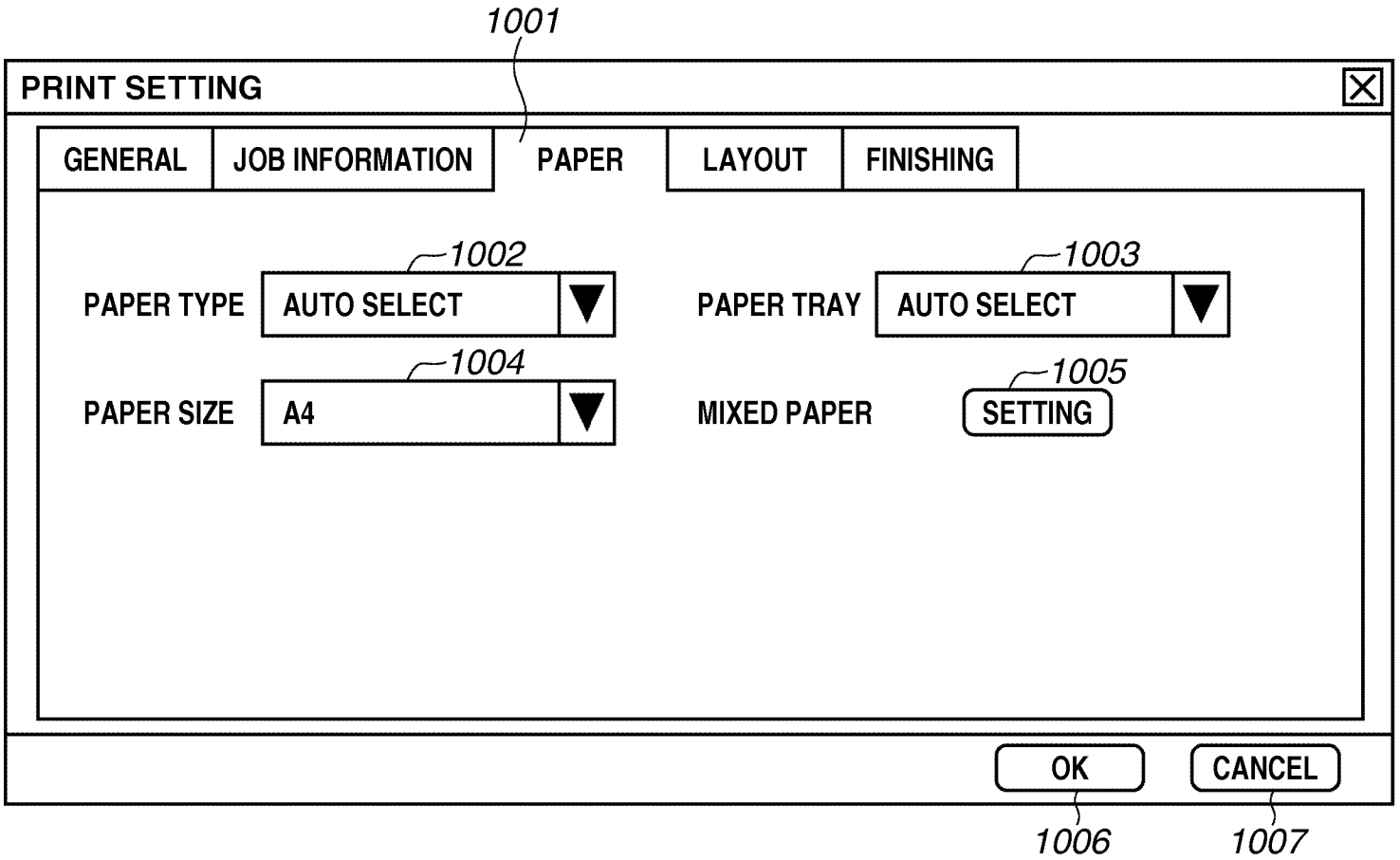
FIG. 10 illustrates an example of a print setting screen.

FIG. 10 illustrates an example of a print setting screen displayed on the display unit 602 of the information processing apparatus 102. The print setting screen is displayed when the user selects the property 905 used for executing the "print setting".

On the print setting screen, a tag 1001 is a tag of a group of print setting items. The tag includes five print setting items, which are "general", "job information", "paper", "layout", and "finishing". The print setting item of "paper" is displayed on the print setting screen in FIG. 10.

The item "paper" is a tag of print setting relating to paper. If the tag "paper" is active, the user can designate the print setting items relating to the paper used for the job.

A paper type box 1002 is where a paper type used for the whole job is displayed. The user can select a paper type from a pull-down menu including, for example, automatic selection and carbonless copy paper (CB). The paper type designated in the paper type box 1002 is used for all the pages of the job.

A paper tray box 1003 is where a paper tray of the whole job is displayed. The user can select a paper tray from a pull-down menu including, for example, automatic selection, cassette 1, and manual feed. The paper set in the paper tray designated in the paper tray box 1003 is used for all pages of the job.

A paper size box 1004 is where a paper size of the whole job is displayed. The user can select a paper size from a pull-down menu including, for example, A3, A4, B4, B5, and LTR. The paper size designated in the paper size box 1004 is used for all pages of the job.

A mixed paper button 1005 is selected if the user does not want to print the whole job using a same type/size of paper or paper fed from a same paper tray. When the mixed paper button 1005 is selected, a mixed paper setting screen as the one illustrated in FIG. 11 will be displayed.

An OK button 1006 is used for reflecting the content designated on the print setting screen. If the user clicks the OK button 1006, the print setting screen is closed. A cancel button 1007 is used for cancelling the content designated on the print setting screen. If the user clicks the cancel button 1007, the print setting screen is closed.

Figure 11:
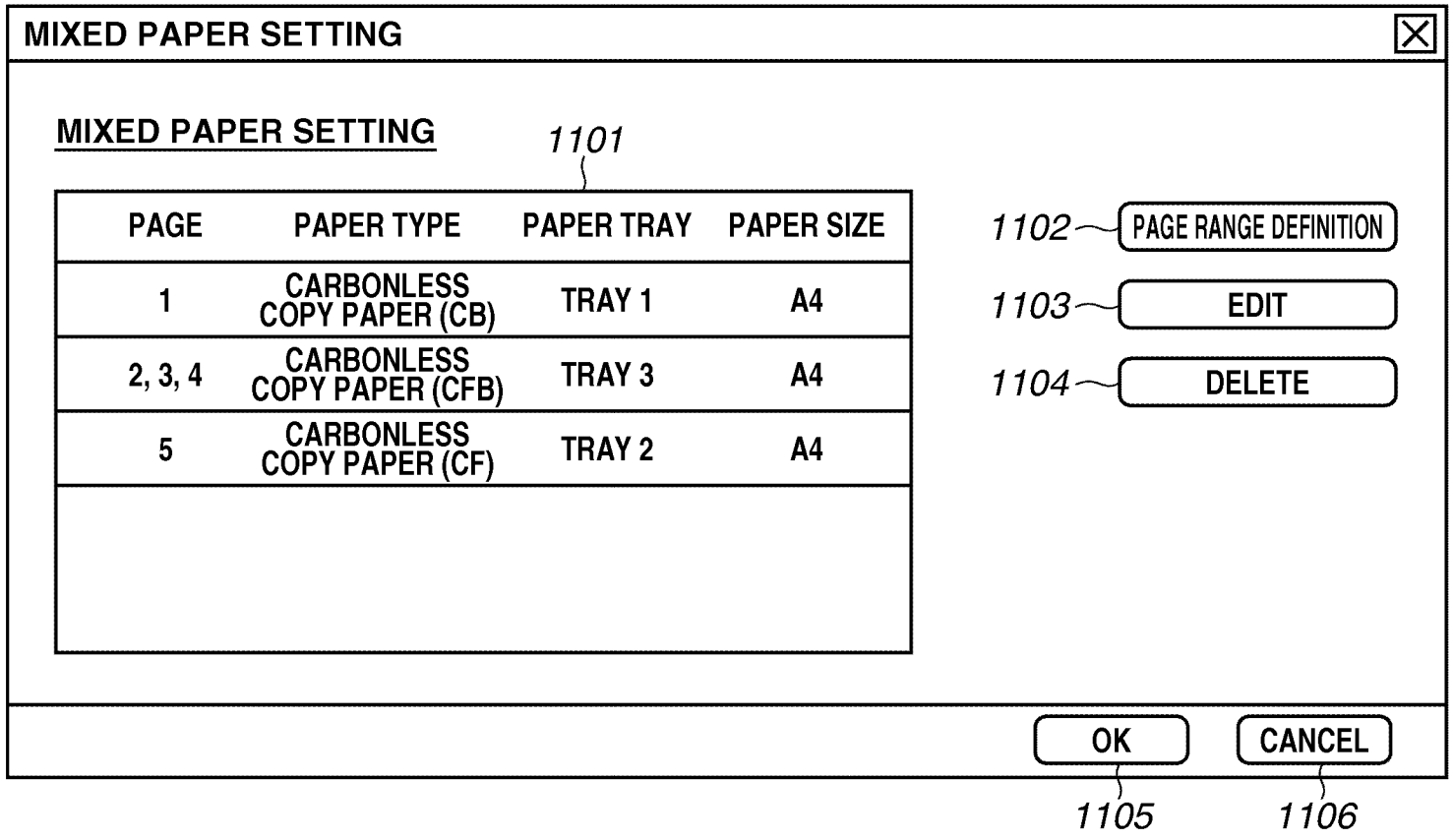
FIG. 11 illustrates an example of a mixed paper setting screen.

FIG. 11 illustrates an example of the mixed paper setting screen displayed on the display unit 602 of the information processing apparatus 102.

A mixed setting display field 1101 on the mixed paper setting screen is where the mixed setting information is displayed. To be more precise, in the mixed setting display field 1101, the designated paper print setting items (type, tray, and size of paper) is displayed for each of the first to the fifth pages.

A page range definition button 1102 is used for newly designating a print setting item. If the user clicks the page range definition button 1102, a page range definition screen such as the one illustrated in FIG. 12 will be displayed. A value designated on the page range definition screen is reflected to the mixed setting display field 1101 (for example, the designated value is stored in the RAM 608 as the mixed setting information).

An edit button 1103 is used for editing the setting-completed content (mixed setting information). By selecting one item from the mixed setting information in the mixed setting display field 1101 and clicking the edit button 1103, the user can edit the selected mixed setting information.

A delete button 1104 is used for deleting the mixed setting information. By selecting one item from the mixed setting information from the mixed setting display field 1101 and clicking the delete button 1104, the user can delete the selected mixed setting information.

An OK button 1105 is used for storing the mixed setting information in the mixed setting display field 1101. If the user clicks the OK button 1105, for example, the mixed setting information in the mixed setting display field 1101 (RAM 608) is added to the job setting information (in a broad sense, stored in the HDD 609 or the like), the mixed paper setting screen is closed and the print setting screen is displayed again. A cancel button 1106 is used for cancelling the mixed setting information in the mixed setting display field 1101. If the user clicks the cancel button 1106, the mix paper setting screen is closed and the print setting screen is displayed again.

Figure 12:
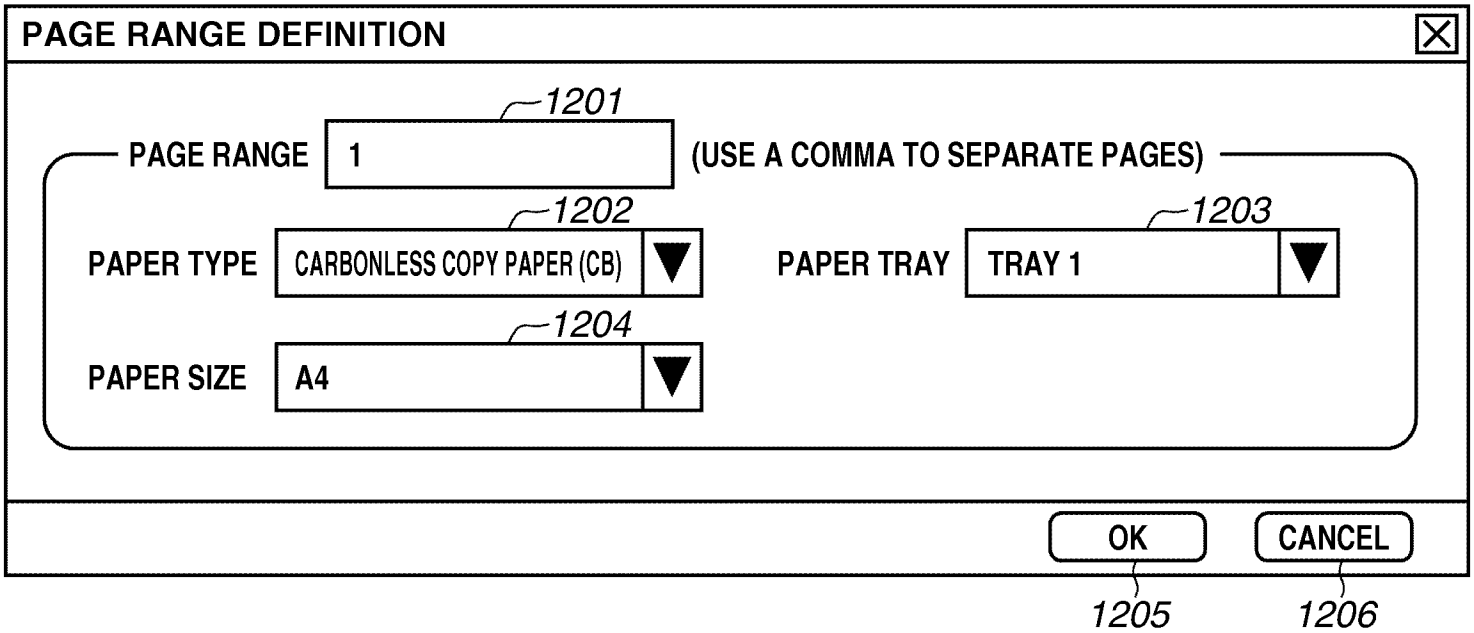
FIG. 12 illustrates an example of a page range definition screen.

FIG. 12 illustrates an example of the page range definition screen displayed on the display unit 602 of the information processing apparatus 102.

On the page range definition screen, an input box 1201 is used for receiving input of a page range. Items such as paper type, paper tray, and paper size are designated for the page(s) input in the input box 1201.

A paper type box 1202 is where a paper type is displayed. The user can select a paper type from a pull-down menu including, for example, automatic selection and carbonless copy paper (CB). A paper tray box 1203 is where a paper tray is displayed. The user can select a paper tray from a pull-down menu including, for example, automatic selection, tray 1, and manual feed. The paper size box 1204 is where a paper size is displayed. The user can select a paper size from a pull-down menu including, for example, A3, A4, B4, B5, and LTR.

An OK button 1205 is used for storing the value designated on the page range definition screen. For example, the designated value is stored in the RAM 608 as mixed setting information. If the user clicks the OK button 1205, the page range definition screen is closed and the mixed paper setting screen is displayed again.

A cancel button 1206 is used for cancelling the values designated on the page range definition screen. If the user clicks the cancel button 1206, the page range definition screen is closed and the mixed paper setting screen is displayed again.

For example, if the user determines to use carbonless copy paper (CB), carbonless copy paper (CFB), and carbonless copy paper (CF) for printing, the user can check the values of the designated print setting items for each page designated in the page range definition screen using the mixed paper setting screen.

Figure 13:
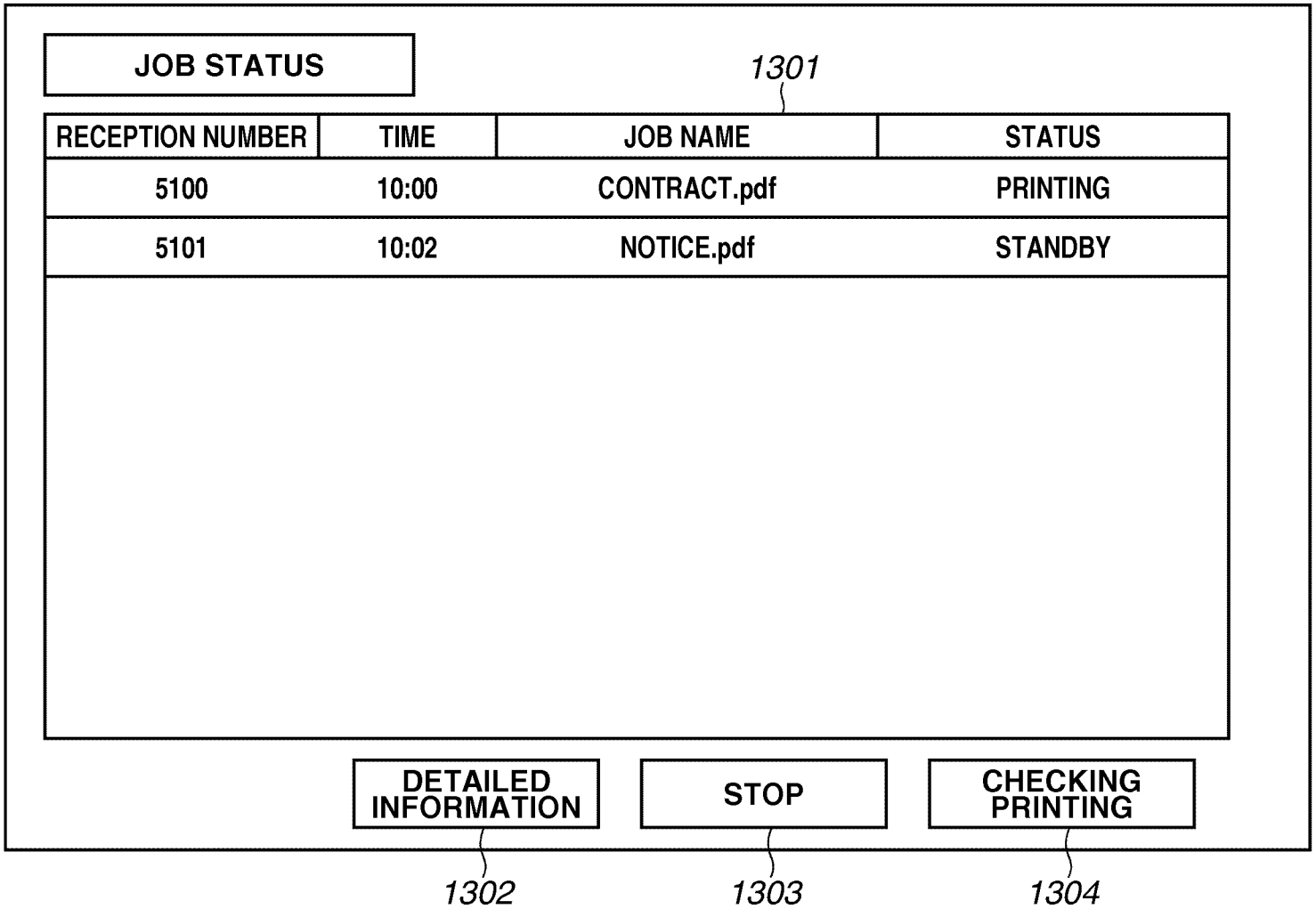
FIG. 13 illustrates an example of a job status screen.

FIG. 13 illustrates an example of a job status screen displayed on the display unit 602 of the image forming apparatus 101. On the job status screen, a job status display field 1301 is where the job status (reception number, reception time, job name, and status) is displayed. On the job status screen in FIG. 13, the job status display field 1301 includes job statuses of two jobs.

A detailed information button 1302 is used for displaying detailed information of the job. If the user clicks the detailed information button 1302, information not displayed on the job status display field 1301, such as the number of printing-completed pages, is displayed on a detailed information screen (not illustrated).

A stop button 1303 is used for stopping a job. If the user selects a job from the job status display field 1301 and clicks the stop button 1303, the selected job will be stopped.

A checking printing button 1304 is used for executing checking printing. If the user selects a job from the job status display field 1301 and clicks the checking printing button 1304, a checking printing screen such as the one displayed in FIG. 14 will be displayed.

The checking printing button 1304 is activated only when the selected job is being processed (during printing). If a job which is not in the printing process is selected, the checking printing button 1304 will gray-out and the checking printing button 1304 cannot be selected.

Figure 14:
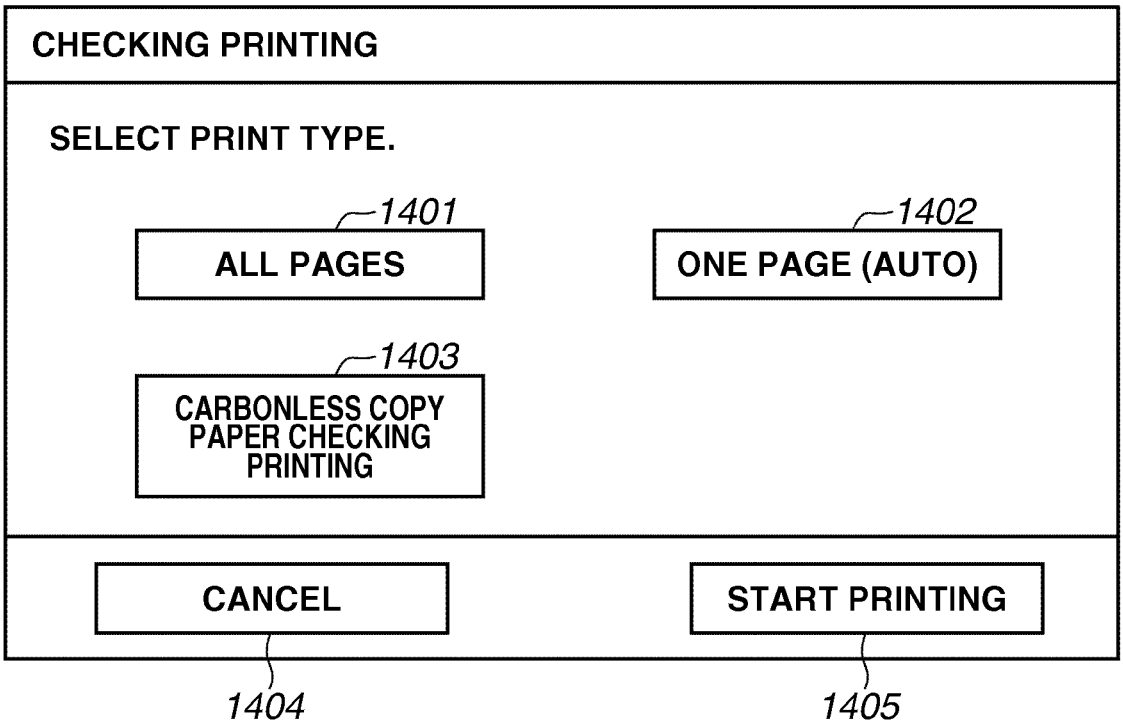
FIG. 14 illustrates an example of a checking printing screen.

FIG. 14 illustrates an example of the checking printing screen displayed on the display unit 602 of the image forming apparatus 101.

Three buttons, including an all pages button 1401, a one page (auto) button 1402, and a carbonless copy paper checking printing button 1403, are arranged on the checking printing screen. The user is allowed to choose only one button at a time in determining the type of checking printing.

A cancel button 1404 is used for cancelling the checking printing. If the user clicks the cancel button 1404, the checking printing screen is closed and the job status screen is displayed again.

A print start button 1405 is used for executing the checking printing. If the user clicks the print start button 1405, the checking printing processing according to the type of the checking printing which has been selected is executed and the screen is automatically changed to the job status screen.

To be more precise, after clicking the all pages button 1401, if the user clicks the print start button 1405, the image forming apparatus 101 outputs one set of printed sheets of the print job for the checking printing. For example, if the print job is set to print 100 copies of a 10-page set, 10 pages will be output for the checking printing.

Further, after clicking the one page (auto) button 1402, if the user clicks the print start button 1405, according to the clicking timing of the print start button 1405, a checking printing of an arbitrary page of the print job is output. For example, if the print job is set to print 100 copies of a 10-page set, any one of the first to the tenth page will be output for the checking printing.

Further, after clicking the carbonless copy paper checking printing button 1403, if the user clicks the print start button 1405, the carbonless copy paper checking printing processing described below is executed.

In the description below, an example of an output control method regarding checking printing of a target page on carbonless copy paper and outputting minimum required carbonless copy paper for copy checking will be described.

Figure 15:
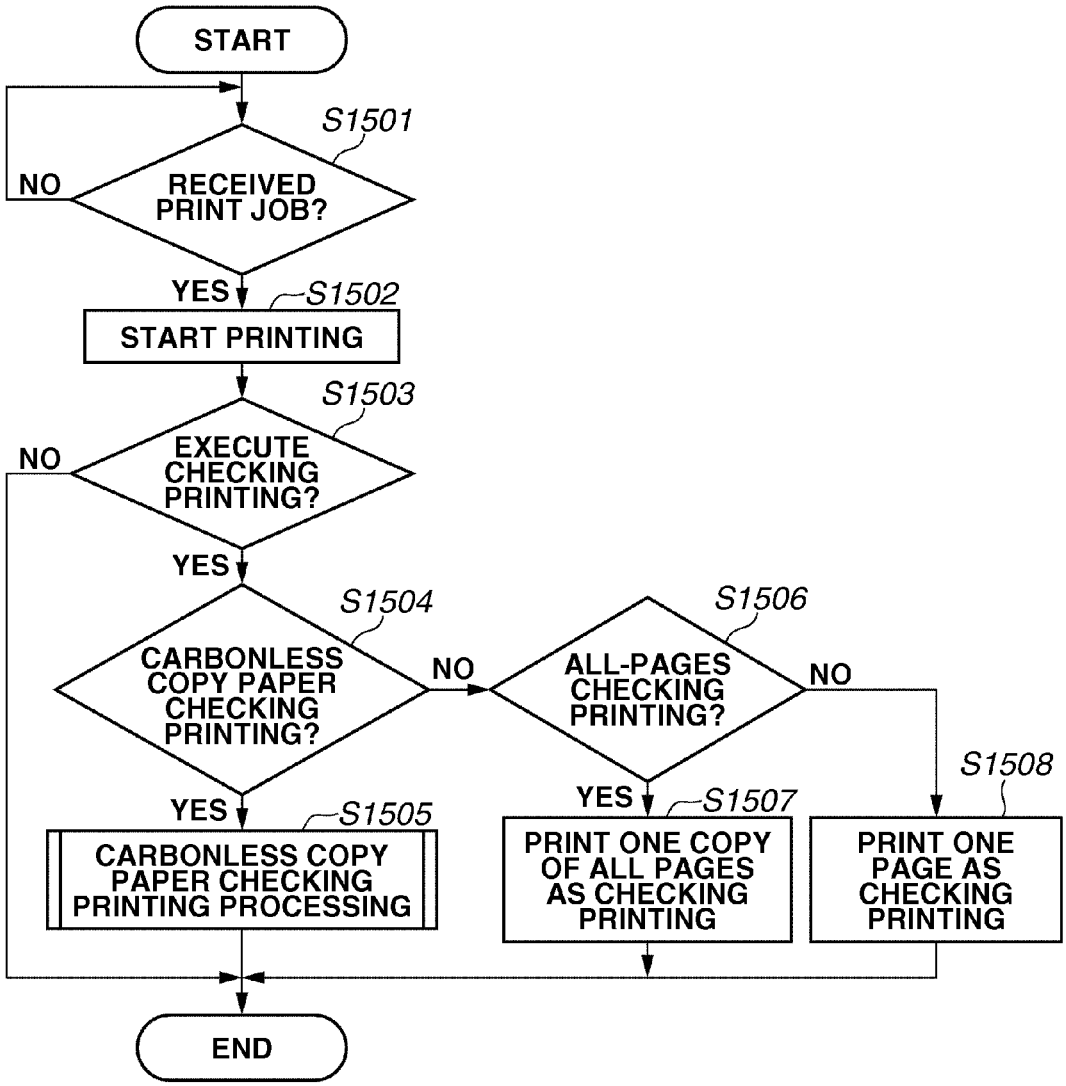
FIG. 15 illustrates an example of checking printing processing according to the first exemplary embodiment.

FIG. 15 is an example of a flowchart illustrating the checking printing processing executed by the image forming apparatus 101.

In step S1501, the apparatus control unit 702 determines whether a print job has been received. In other words, the apparatus control unit 702 waits until the user starts the printing operation via the job management application on the information processing apparatus 102. To be more precise, in response to the user's printing start operation of the PD 605, the job control unit 706 transmits job setting information and an RIP image to the apparatus control unit 702. When the apparatus control unit 702 receives the job setting information and the RIP image, it determines that it has received a print job (YES in step S1501), and the processing proceeds to step S1502. If the apparatus control unit 702 determines that it has not yet received a print job (NO in step S1501), step S1501 is repeated. In step S1502, the apparatus control unit 702 starts the printing operation using the job setting information and the RIP image.

In step S1503, the apparatus control unit 702 determines whether the execution of the checking printing has been requested. If the apparatus control unit 702 determines that the execution of the checking printing has been requested (YES in step S1503), the processing proceeds to step S1504. If the apparatus control unit 702 determines that the execution of the checking printing has not been requested (NO in step S1503), then the processing ends.

For example, if the user executes the checking printing, the user selects a job whose printing is in progress from the job status screen displayed on the operation panel 323, and clicks the checking printing button 1304 (an example of user operation). Accordingly, the checking printing screen is displayed on the operation panel 323. Then, the user clicks any one button from the all pages button 1401, the one page (auto) button 1402, and the carbonless copy paper checking printing button 1403, and clicks the print start button 1405.

In step S1503, the UI processing unit 701 sends information of the type of the selected checking printing and an execution instruction of the checking printing to the apparatus control unit 702.

In step S1504, the apparatus control unit 702 determines whether the selected checking printing is checking printing using carbonless copy paper. If the apparatus control unit 702 determines that the checking printing uses carbonless copy paper (YES in step S1504), the processing proceeds to step S1505. If the apparatus control unit 702 determines that the checking printing does not use carbonless copy paper (NO in step S1504), the processing proceeds to step S1506.

In step S1505, the apparatus control unit 702 executes the carbonless copy paper checking printing processing. Details of this processing will be described with reference to FIG. 16. When the processing in step S1505 ends, the processing performed by the apparatus control unit 702 ends.

In step S1506, the apparatus control unit 702 determines whether the selected checking printing is all-pages checking printing. If the apparatus control unit 702 determines that the checking printing is all-pages checking printing (YES in step S1506), the processing proceeds to step S1507. If the apparatus control unit 702 determines that the checking printing is not all-pages checking printing (NO in step S1506), the processing proceeds to step S1508.

In step S1507, the apparatus control unit 702 outputs one copy of all pages based on the job setting information and the RIP image as the checking print. The copy is discharged to the escape tray 404. When the processing in step S1507 ends, the processing performed by the apparatus control unit 702 ends.

In step S1508, the apparatus control unit 702 prints the same page as the page currently being printed (hereinafter referred to as the checking printing target page) as the checking print and outputs the printed page onto the escape tray 404. When the processing in step S1508 ends, the processing performed by the apparatus control unit 702 ends.

Figure 16:
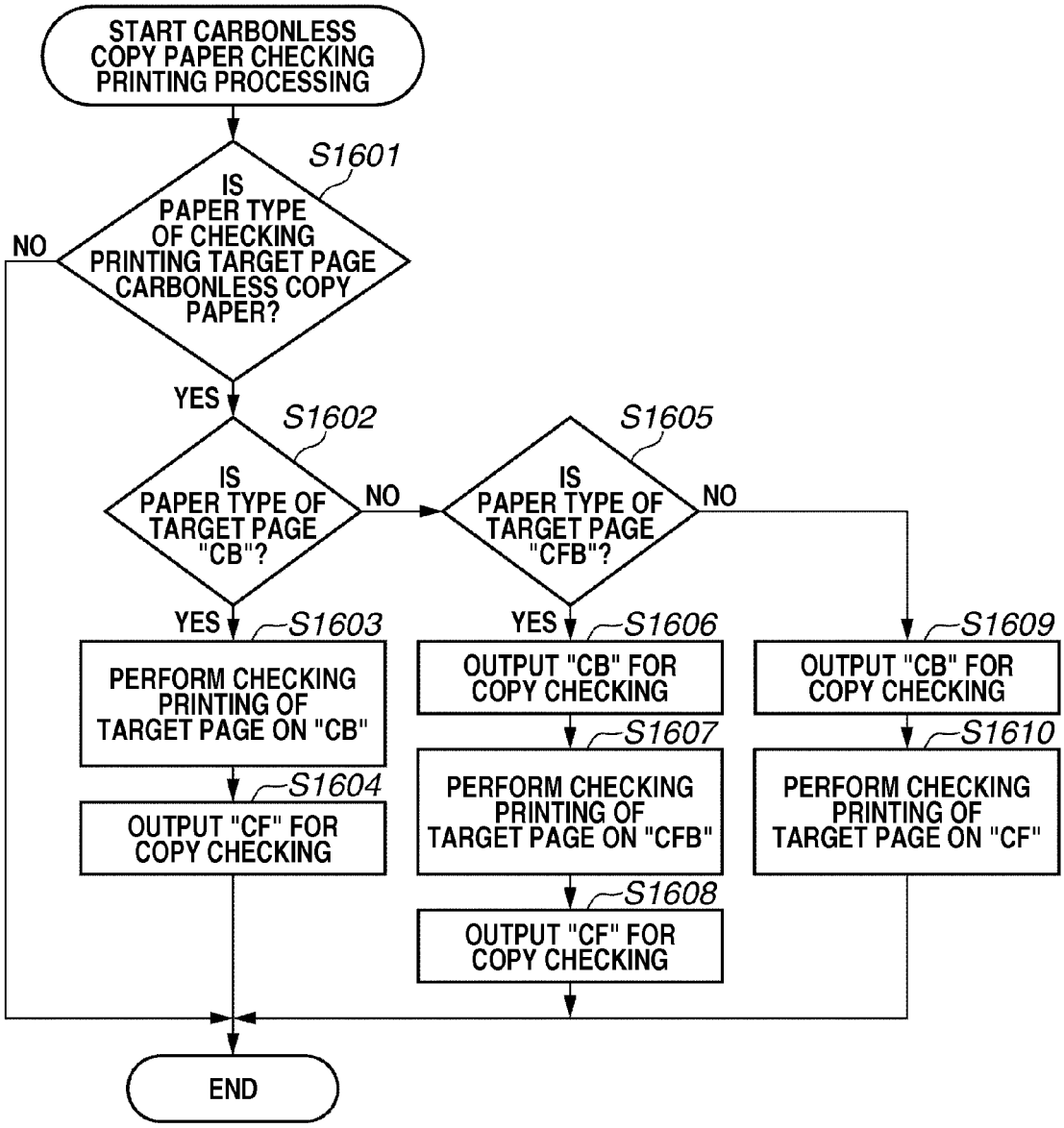
FIG. 16 illustrates an example of a result of carbonless copy paper checking printing processing according to the first exemplary embodiment.

FIG. 16 is a flowchart illustrating an example of the carbonless copy paper checking printing processing.

In step S1601, the apparatus control unit 702 determines whether the recording medium of the checking printing target page is carbonless copy paper. If the apparatus control unit 702 determines that the recording medium is carbonless copy paper (YES in step S1601), the processing proceeds to step S1602. If the apparatus control unit 702 determines that the recording medium is not carbonless copy paper (NO in step S1601), the processing ends.

In step S1602, the apparatus control unit 702 determines whether the recording medium of the checking printing target page is carbonless copy paper (CB). If the apparatus control unit 702 determines that the recording medium of the checking printing target page is "CB" (YES in step S1602), the processing proceeds to step S1603. If the apparatus control unit 702 determines that the recording medium of the checking printing target page is not "CB" (NO in step S1602), the processing proceeds to step S1605.

In step S1603, the apparatus control unit 702 prints the checking printing target page on the carbonless copy paper (CB) and discharges the printed page to the escape tray 404. In step S1604, in order to output carbonless copy paper for copy checking, the apparatus control unit 702 identifies a page which is to be printed on the carbonless copy paper (CF) just after printing of the checking printing target page based on the job setting information. Subsequently, the apparatus control unit 702 prints an RIP image of the identified page on the carbonless copy paper (CF). Then, the printed page is discharged to the escape tray 404, and the processing ends.

On the other hand, in step S1605, the apparatus control unit 702 determines whether the recording medium of the checking printing target page is carbonless copy paper (CFB). If the apparatus control unit 702 determines that the recording medium of the checking printing target page is "CFB" (YES in step S1605), the processing proceeds to step S1606. If the apparatus control unit 702 determines that the recording medium of the checking printing target page is not "CFB" (NO in step S1605), the processing proceeds to step S1609.

In step S1606, in order to output carbonless copy paper for copy checking, the apparatus control unit 702 identifies a page which is to be printed on the carbonless copy paper (CB) just before printing of the checking printing target page based on the job setting information. Subsequently, the apparatus control unit 702 prints an RIP image of the identified page on the carbonless copy paper (CB). Then, the printed page is discharged to the escape tray 404, and the processing proceeds to step S1607.

In step S1607, the apparatus control unit 702 prints the checking printing target page on the carbonless copy paper (CFB) and discharges the printed page to the escape tray 404. In step S1608, the apparatus control unit 702 identifies a page which is to be printed on the carbonless copy paper (CF) just after printing of the checking printing target page based on the job setting information. Subsequently, the apparatus control unit 702 prints an RIP image of the identified page on the carbonless copy paper (CF). Then, the printed page is discharged to the escape tray 404, and the processing ends.

In step S1609, in order to output carbonless copy paper for copy checking, the apparatus control unit 702 identifies a page which is to be printed on the carbonless copy paper (CB) just before printing of the checking printing target page based on the job setting information. Subsequently, the apparatus control unit 702 prints an RIP image of the identified page on the carbonless copy paper (CB). Then, the printed page is discharged to the escape tray 404, and the processing proceeds to step S1610.

In step S1610, the apparatus control unit 702 prints the checking printing target page on the carbonless copy paper (CF) and discharges the printed page to the escape tray 404. Then, the processing ends.

Figure 17A:
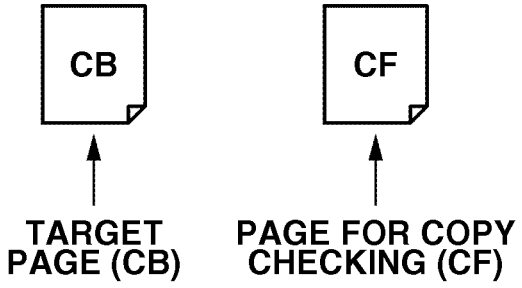
FIGS. 17A, 17B, and 17C illustrate results of the carbonless copy paper checking printing processing according to the first exemplary embodiment.
Figure 17B:
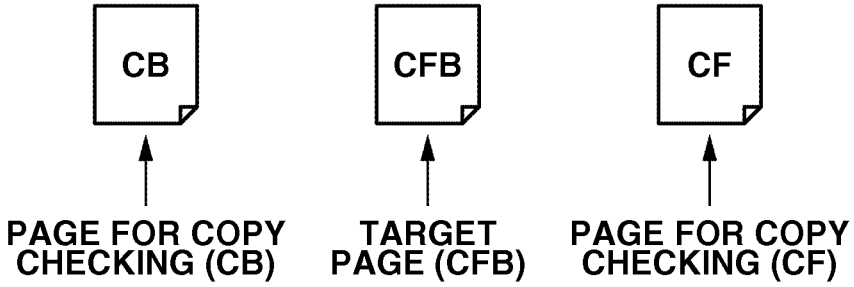
Figure 17C:
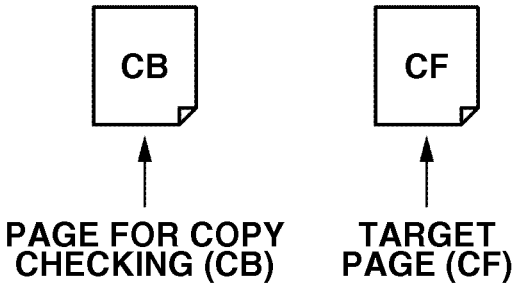

FIGS. 17A, 17B, and 17C illustrate results of the carbonless copy paper checking printing processing.

FIG. 17A illustrates an example of a case where the recording medium of the checking printing target page is carbonless copy paper (CB). In FIG. 17A, carbonless copy paper (CB) on which the checking printing target page is printed is output first, and carbonless copy paper (CF) as the carbonless copy paper for copy checking is output next.

FIG. 17B illustrates an example of a case where the recording medium of the checking printing target page is carbonless copy paper (CFB). In FIG. 17B, carbonless copy paper (CB) as the carbonless copy paper for copy checking is output first, carbonless copy paper (CFB) on which the checking printing target page is printed is output second, and carbonless copy paper (CF) as the carbonless copy paper for copy checking is output last.

FIG. 17C illustrates an example of a case where the recording medium of the checking printing target page is carbonless copy paper (CF). In FIG. 17C, carbonless copy paper (CF) as the carbonless copy paper for copy checking is output first, and carbonless copy paper (CF) on which the checking printing target page is printed is output next.

Thus, according to the present embodiment, as illustrated in FIGS. 17A, 17B, and 17C, in each case, in an order by which the feasibility of the copying of the carbonless copy paper can be checked, carbonless copy paper can be automatically output by the minimum number of sheets required for the checking. Thus, the checking can be performed without wasting output of carbonless copy paper.

Further, according to the above-described configuration, appropriate carbonless copy paper for copy checking can be automatically output according to the type of carbonless copy paper which is used at the time of checking printing. Thus, the user does not need to prepare carbonless copy paper for copy checking.

According to a second exemplary embodiment of the present invention, carbonless copy paper for copy checking is output together with the carbonless copy paper on which the checking printing target page is printed according to a type of the carbonless copy paper used for the job. According to the present embodiment, components similar to those in the first exemplary embodiment are denoted by the same reference numerals and their descriptions are not repeated.

Figure 18:
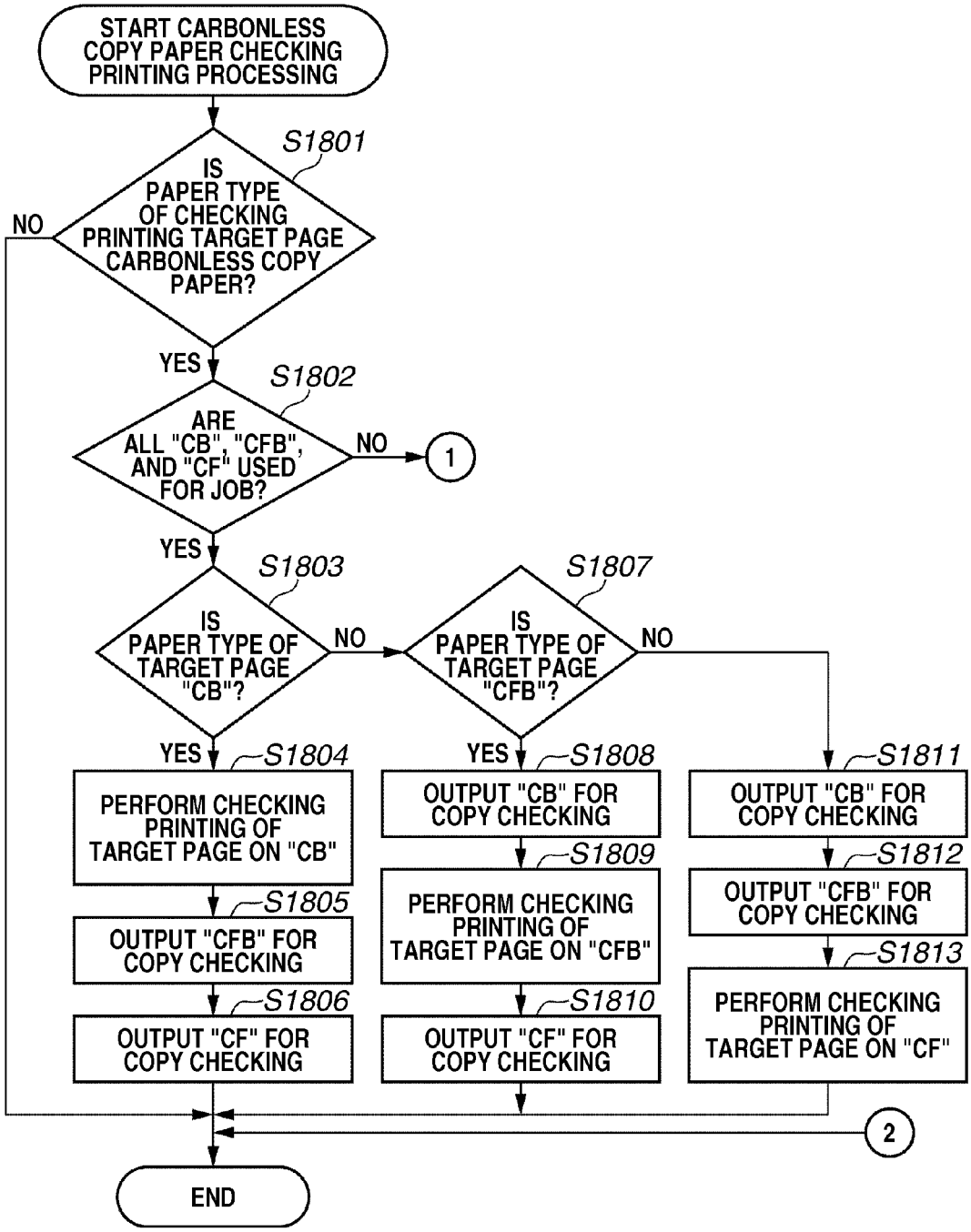
FIG. 18 is a flowchart illustrating an example of the carbonless copy paper checking printing processing according to a second exemplary embodiment of the present invention.
Figure 19:
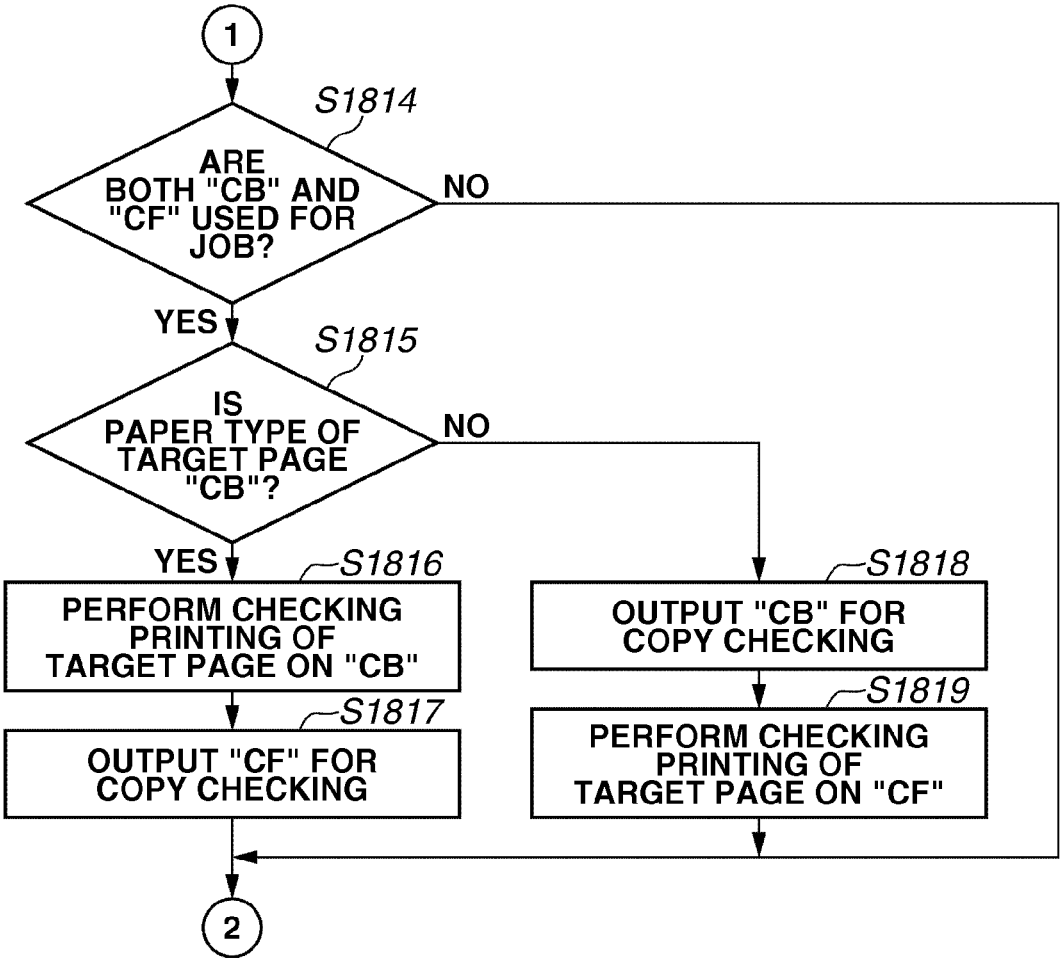
FIG. 19 illustrates an example of the carbonless copy paper checking printing processing according to the second exemplary embodiment.

The carbonless copy paper checking printing processing according to the second exemplary embodiment will now be described with reference to FIGS. 18 and 19. FIGS. 18 and 19 correspond to FIG. 16 according to the first exemplary embodiment.

FIGS. 18 and 19 are flowcharts illustrating examples of the carbonless copy paper checking printing processing.

In step S1801, the apparatus control unit 702 determines whether the recording medium of the checking printing target page is carbonless copy paper. If the apparatus control unit 702 determines that the recording medium is carbonless copy paper (YES in step S1801), the processing proceeds to step S1802. If the apparatus control unit 702 determines that the recording medium is not carbonless copy paper (NO in step S1801), the processing ends.

In step S1802, the apparatus control unit 702 analyzes the type of carbonless copy paper used for the job based on the job setting information. As a result, if the apparatus control unit 702 determines that the job uses all of the carbonless copy paper (CB), carbonless copy paper (CFB), and carbonless copy paper (CF) (YES in step S1802), the processing proceeds to step S1803. On the other hand, if the apparatus control unit 702 determines that the job does not use all of the types of carbonless copy paper (NO in step S1802), the processing proceeds to step S1814 in FIG. 19.

In step S1803, the apparatus control unit 702 determines whether the recording medium of the checking printing target page is carbonless copy paper (CB). If the apparatus control unit 702 determines that the recording medium of the checking printing target page is "CB" (YES in step S1803), the processing proceeds to step S1804. If the apparatus control unit 702 determines that the recording medium of the checking printing target page is not "CB" (NO in step S1803), the processing proceeds to step S1807.

In step S1804, the apparatus control unit 702 prints the checking printing target page on the carbonless copy paper (CB) and discharges the printed page to the escape tray 404.

In step S1805, in order to output carbonless copy paper for copy checking, the apparatus control unit 702 identifies a page which is to be printed on the carbonless copy paper (CFB) just after printing of the checking printing target page based on the job setting information. Subsequently, the apparatus control unit 702 prints an RIP image of the identified page on the carbonless copy paper (CFB). Then, the printed page is discharged to the escape tray 404, and the processing proceeds to step S1806.

In step S1806, in order to output carbonless copy paper for copy checking, the apparatus control unit 702 identifies the page which is to be printed on the carbonless copy paper (CF) just after printing of the checking printing target page based on the job setting information. Subsequently, the apparatus control unit 702 prints an RIP image of the identified page on the carbonless copy paper (CF). Then, the printed page is discharged to the escape tray 404, and the processing ends.

In step S1807, the apparatus control unit 702 determines whether the recording medium of the checking printing target page is carbonless copy paper (CFB). If the apparatus control unit 702 determines that the recording medium of the checking printing target page is "CFB" (YES in step S1807), the processing proceeds to step S1808. If the apparatus control unit 702 determines that the recording medium of the checking printing target page is not "CFB" (NO in step S1807), the processing proceeds to step S1811.

In step S1808, in order to output carbonless copy paper for copy checking, the apparatus control unit 702 identifies a page which is to be printed on the carbonless copy paper (CB) just before printing of the checking printing target page based on the job setting information. Subsequently, the apparatus control unit 702 prints an RIP image of the identified page on the carbonless copy paper (CB). Then, the printed page is discharged to the escape tray 404, and the processing proceeds to step S1809.

In step S1809, the apparatus control unit 702 prints the checking printing target page on the carbonless copy paper (CFB) and discharges the printed page to the escape tray 404. Then, the processing proceeds to step S1810.

In step S1810, in order to output carbonless copy paper for copy checking, the apparatus control unit 702 identifies a page which is to be printed on the carbonless copy paper (CF) just after printing of the checking printing target page based on the job setting information. Subsequently, the apparatus control unit 702 prints an RIP image of the identified page on the carbonless copy paper (CF). Then, the printed page is discharged to the escape tray 404, and the processing ends.

In step S1811, in order to output carbonless copy paper for copy checking, the apparatus control unit 702 identifies a page which is to be printed on the carbonless copy paper (CB) just before printing of the checking printing target page based on the job setting information. Subsequently, the apparatus control unit 702 prints an RIP image of the identified page on the carbonless copy paper (CB). Then, the printed page is discharged to the escape tray 404, and the processing proceeds to step S1812.

In step S1812, in order to output carbonless copy paper for copy checking, the apparatus control unit 702 identifies a page which has been printed on the carbonless copy paper (CFB) just after the page printed in step S1811 based on the job setting information. Subsequently, the apparatus control unit 702 prints an RIP image of the identified page on the carbonless copy paper (CFB). Then, the printed page is discharged to the escape tray 404, and the processing proceeds to step S1813.

In step S1813, the apparatus control unit 702 prints the checking printing target page on the carbonless copy paper (CF) and discharges the printed page to the escape tray 404. Then, the processing ends.

In step S1814, the apparatus control unit 702 analyzes the type of carbonless copy paper used for the job based on the job setting information. As a result, if the apparatus control unit 702 determines that the job uses both the carbonless copy paper (CB) and carbonless copy paper (CF) (YES in step S1814), the processing proceeds to step S1815. On the other hand, if the apparatus control unit 702 determines that the job does not use both types of carbonless copy paper (NO in step S1814), then the processing ends.

In step S1815, the apparatus control unit 702 determines whether the recording medium of the checking printing target page is carbonless copy paper (CB). If the apparatus control unit 702 determines that the recording medium of the checking printing target page is "CB" (YES in step S1815), the processing proceeds to step S1816. If the apparatus control unit 702 determines that the recording medium of the checking printing target page is not "CB" (NO in step S1815), the processing proceeds to step S1818.

In step S1816, the apparatus control unit 702 prints the checking printing target page on the carbonless copy paper (CB) and discharges the printed page to the escape tray 404. Then, the processing proceeds to step S1817.

In step S1817, in order to output carbonless copy paper for copy checking, the apparatus control unit 702 identifies a page which is to be printed on the carbonless copy paper (CF) just after printing of the checking printing target page based on the job setting information. Then, the apparatus control unit 702 prints an RIP image of the identified page on the carbonless copy paper (CF). Then, the printed page is discharged to the escape tray 404, and the processing ends.

In step S1818, in order to output carbonless copy paper for copy checking, the apparatus control unit 702 identifies a page which is to be printed on the carbonless copy paper (CB) just before printing of the checking printing target page based on the job setting information. Subsequently, the apparatus control unit 702 prints an RIP image of the identified page on the carbonless copy paper (CB). Then, the printed page is discharged to the escape tray 404, and the processing proceeds to step S1819.

In step S1819, the apparatus control unit 702 prints the checking printing target page on the carbonless copy paper (CF) and discharges the printed page to the escape tray 404. Then, the processing ends.

Figure 20:
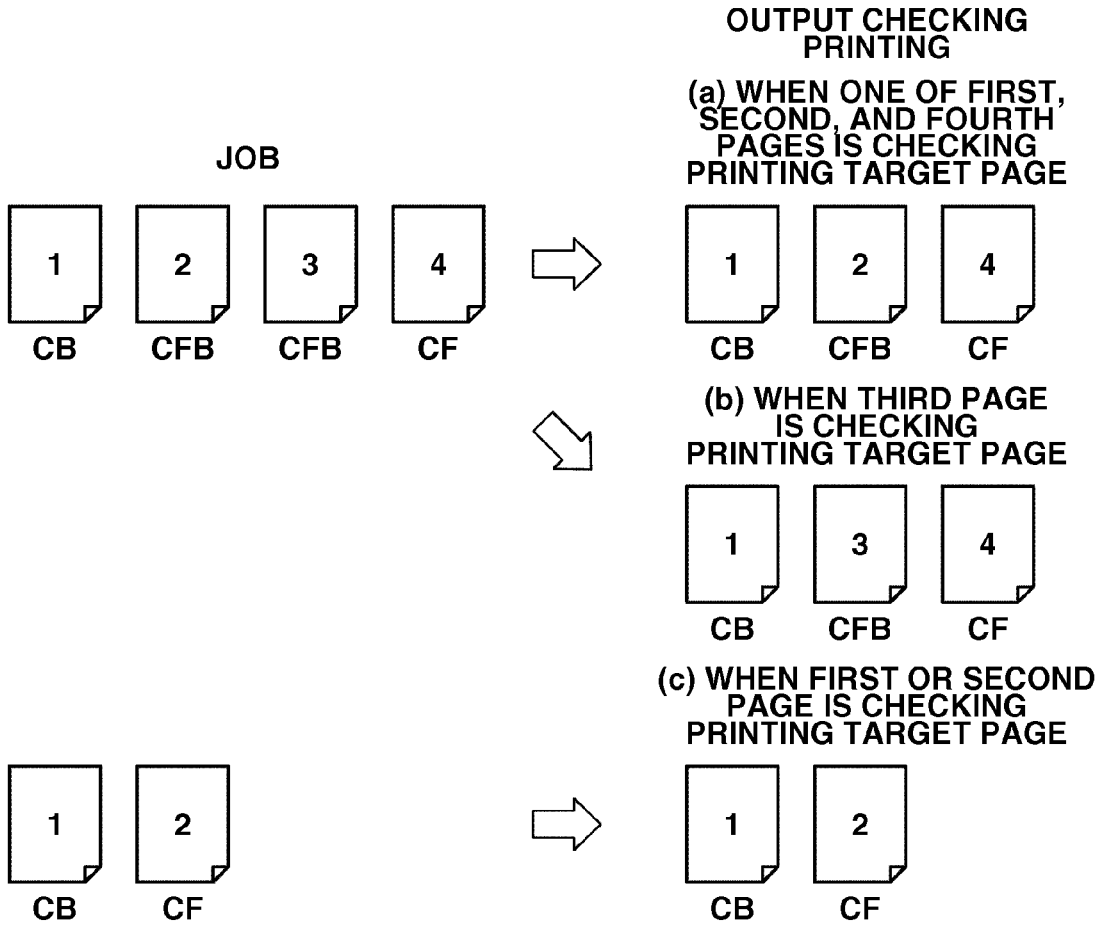
FIG. 20 illustrates an example of a result of the carbonless copy paper checking printing processing according to the second exemplary embodiment.

FIG. 20 illustrates an example of a result of the carbonless copy paper checking printing processing.

In FIG. 20, constituent pages of two jobs (print jobs) are illustrated on the left side, and the pages obtained from the checking printing processing are illustrated on the right side. The jobs are illustrated in an abbreviated form. The upper job is to perform repeated printing of a set of four pages: carbonless copy paper (CB)×1, carbonless copy paper (CFB)×2, and carbonless copy paper (CF)×1. The lower job is to perform repeated printing of a set of two pages: carbonless copy paper (CB)×1 and carbonless copy paper (CF)×1.

The result (a) in FIG. 20 illustrates a case where any of the first, second, fourth pages is the checking printing target page regarding the job of repeated printing of carbonless copy paper (CB)×1, carbonless copy paper (CFB)×2, and carbonless copy paper (CF)×1.

The result (b) in FIG. 20 illustrates a case where the third page is the checking printing target page regarding the job of repeated printing of carbonless copy paper (CB)×1, carbonless copy paper (CFB)×2, and carbonless copy paper (CF)×1. The difference from the result (a) is that the third page is printed on the carbonless copy paper (CFB) for the checking printing since the third page is the checking printing target page.

The result (c) in FIG. 20 illustrates a case where the first or the second page is the checking printing target page regarding the job of repeated printing of carbonless copy paper (CB)×1 and carbonless copy paper (CF)×1.

In this manner, according to the present embodiment, all types of carbonless copy paper used for the job are automatically output in such an order that the copy checking of the carbonless copy paper can be performed. Thus, even if the carbonless copy paper is set in the paper feed cassette with the wrong side up, the user can notice the error by the copy checking. This enables reducing the risk of wasting carbonless copy paper, which may be printed if the user is unable to notice the error.

According to a third exemplary embodiment of the present invention, the carbonless copy paper for copy checking is output without being printed (blank). According to the present embodiment, the image forming apparatus 101 includes a charge (billing) counter. Each time one page is printed, the charge counter is incremented. However, if the print page is blank, the charge counter is not incremented. This processing is executed by the apparatus control unit 702. Since other components of the present embodiment are similar to those of the first exemplary embodiment, their descriptions are not repeated.

Next, the checking printing processing of the present embodiment will be described. The checking printing processing is basically similar to the processing in the first exemplary embodiment. However, in each of steps S1604, S1606, S1608, and S1609, the carbonless copy paper for copy checking is output without being printed (no image printed on the carbonless copy paper for copy checking).

According to the above-described configuration, when an image forming apparatus that does not charge for blank paper is used, charging of carbonless copy paper for copy checking can be prevented by using blank carbonless copy paper for copy checking.

According to a fourth exemplary embodiment of the present invention, the carbonless copy paper for copy checking is output without being printed (blank) with respect to the second exemplary embodiment. Since the components of the present embodiment are similar to those of the third exemplary embodiment, their descriptions are not repeated.

The above-described exemplary embodiments can also be achieved by supplying a software program that implements each function of aforementioned exemplary embodiments to a system or an apparatus via a network or various types of storage media, and a computer (or a CPU or a MPU) in the system or the apparatus reads and executes the program stored in such storage media.

According to the configurations of the above-described exemplary embodiments, carbonless copy paper can be appropriately output for print checking.

Aspects of the present invention can also be realized by a computer of a system or apparatus (or devices such as a CPU or MPU) that reads out and executes a program recorded on a memory device to perform the functions of the above-described embodiment(s), and by a method, the steps of which are performed by a computer of a system or apparatus by, for example, reading out and executing a program recorded on a memory device to perform the functions of the above-described embodiment(s). For this purpose, the program is provided to the computer for example via a network or from a recording medium of various types serving as the memory device (e.g., computer-readable medium).

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

This application claims priority from Japanese Patent Application No. 2011-026394 filed Feb. 9, 2011, which is hereby incorporated by reference herein in its entirety.

What is claimed is:

1. An image forming apparatus comprising:

a print unit configured for printing pages of paper;

a user interface configured to received a user operation for instructing checking of printing during printing;

a specifying unit configured to, when the user operation for instructing checking of printing is performed during printing, specify, according to a type of carbonless copy paper of a page being printed, carbonless copy paper for checking corresponding to the carbonless copy paper being printed; and an output unit configured to output the carbonless copy paper being printed and the carbonless copy paper for checking specified by the specifying unit, wherein the specifying unit specifies a top sheet, as the carbonless copy paper for checking corresponding to the carbonless copy paper being printed, when the carbonless copy paper being printed is a bottom sheet, and specifies a bottom sheet, as the carbonless copy paper for checking corresponding to the carbonless copy paper being printed, when the carbonless copy paper being printed is a top sheet.

2. The image forming apparatus according to claim 1, wherein the specifying unit specifies a top sheet and a bottom sheet as the carbonless copy paper for checking corresponding to the carbonless copy paper being printed, when the carbonless copy paper being printed is a middle sheet.

3. The image forming apparatus according to claim 2, wherein, if the top sheet is specified by the specifying unit, the output unit outputs the top sheet before outputting the carbonless copy paper being printed, wherein, if the top sheet and the bottom sheet are specified by the specifying unit, the output unit outputs the top sheet before outputting the carbonless copy paper being printed and outputs the bottom sheet after outputting the carbonless copy paper being printed, and wherein, if the bottom sheet is specified by the specifying unit, the output unit outputs the bottom sheet after outputting the carbonless copy paper being printed.

4. An image forming apparatus comprising:

a print unit configured for printing pages of paper;

a user interface configured to received a user operation for instructing checking of printing during printing;

an identification unit configured to identify, if a user operation for instructing checking of printing is performed during printing, a type of carbonless copy paper used for the printing;

a specifying unit configured to specify carbonless copy paper for checking corresponding to carbonless copy paper of the page being printed according to the type identified by the identification unit; and an output unit configured to output the carbonless copy paper being printed and the carbonless copy paper for checking specified by the specifying unit, wherein the specifying unit specifies a to sheet, as the carbonless copy paper for checking corresponding to the carbonless copy paper being printed, when the carbonless copy paper being printed is a bottom sheet, and specifies a bottom sheet, as the carbonless copy paper for checking corresponding to the carbonless copy paper being printed, when the carbonless copy paper being printed is a top sheet.

5. An output control method comprising:

printing, by a printing unit, pages of paper;

receiving, by a user interface, a user operation for instructing checking of printing during printing;

specifying, when a user operation for instructing checking of printing is performed during printing, according to a type of carbonless copy paper of a page being printed, carbonless copy paper for checking corresponding to the carbonless copy paper being printed; and outputting the carbonless copy paper being printed and the specified carbonless copy paper for checking, wherein the specifying step specifies a top sheet, as the carbonless copy paper for checking corresponding to the carbonless copy paper being printed, when the carbonless copy paper being printed is a bottom sheet, and specifies a bottom sheet, as the carbonless copy paper for checking corresponding to the carbonless copy paper being printed, when the carbonless copy paper being printed is a top sheet.

6. An output control method comprising:

printing, by a printing unit, pages of paper;

receiving, by a user interface, a user operation for instructing checking of printing during printing;

identifying, if a user operation for instructing checking of printing is performed during printing, a type of carbonless copy paper used for the printing;

specifying carbonless copy paper for checking corresponding to carbonless copy paper of a page being printed according to the identified type; and outputting the carbonless copy paper being printed and the specified carbonless copy paper for checking, wherein the specifying step specifies a to sheet, as the carbonless copy paper for checking corresponding to the carbonless copy paper being printed, when the carbonless copy paper being printed is a bottom sheet, and specifies a bottom sheet, as the carbonless copy paper for checking corresponding to the carbonless copy paper being printed, when the carbonless copy paper being printed is a top sheet.

7. A non-transitory computer-readable storage medium storing a program that causes a computer to execute a method comprising:

printing, by a printing unit, pages of paper;

receiving, by a user interface, a user operation for instructing checking of printing during printing;

specifying, when a user operation for instructing checking of printing is performed during printing, according to a type of carbonless copy paper of a page being printed, carbonless copy paper for checking corresponding to the carbonless copy paper being printed; and outputting the carbonless copy paper being printed and the specified carbonless copy paper for checking, wherein the specifying step specifies a to sheet, as the carbonless copy paper for checking corresponding to the carbonless copy paper being printed, when the carbonless copy paper being printed is a bottom sheet, and specifies a bottom sheet, as the carbonless copy paper for checking corresponding to the carbonless copy paper being printed, when the carbonless copy paper being printed is a top sheet.

8. A non-transitory computer-readable storage medium storing a program that causes a computer to execute a method comprising:

printing, by a printing unit, pages of paper;

receiving, by a user interface, a user operation for instructing checking of printing during printing;

identifying, if a user operation for instructing checking of printing is performed during printing, a type of carbonless copy paper used for the printing;

specifying carbonless copy paper for checking corresponding to carbonless copy paper of a page being printed according to the identified type; and outputting the carbonless copy paper being printed and the specified carbonless copy paper for checking, wherein the specifying step specifies a top sheet, as the carbonless copy paper for checking corresponding to the carbonless copy paper being printed, when the carbonless copy paper being printed is a bottom sheet, and specifies a bottom sheet, as the carbonless copy paper for checking corresponding to the carbonless copy paper being printed, when the carbonless copy paper being printed is a top sheet.

* * * * *